US012729449B2

(12) United States Patent
Coridan et al.

(10) Patent No.: US 12,729,449 B2
(45) Date of Patent: Sep. 8, 2026

(54) DEVICES AND METHODS FOR ELECTROCATALYTIC HYDROGEN PRODUCTION

(71) Applicant: BOARD OF TRUSTEES OF THE UNIVERSITY OF ARKANSAS, Little Rock, AR (US)

(72) Inventors: Robert Henry Coridan, Fayetteville, AR (US); Zebulon George Schichtl, Conway, AR (US); Hamed Mehrabi, Fayetteville, AR (US)

(73) Assignee: BOARD OF TRUSTEES OF THE UNIVERSITY OF ARKANSAS, Little Rock, AR (US)

( * ) Notice: Subject to any disclaimer, the term of this patent is extended or adjusted under 35 U.S.C. 154(b) by 642 days.

(21) Appl. No.: 17/859,109

(22) Filed: Jul. 7, 2022

(65) Prior Publication Data

US 2023/0010771 A1 Jan. 12, 2023

Related U.S. Application Data

(60) Provisional application No. 63/218,963, filed on Jul. 7, 2021.

(51) Int. Cl.

| | |
|---|---|
| ***C25B 11/087*** | (2021.01) |
| ***C25B 1/02*** | (2006.01) |
| ***C25B 1/55*** | (2021.01) |
| ***C25B 11/081*** | (2021.01) |

(52) U.S. Cl.

CPC ..... *C25B 11/087* (2021.01); *C25B 1/02* (2013.01); *C25B 1/55* (2021.01); *C25B 11/081* (2021.01)

(58) Field of Classification Search

CPC ..... C25B 1/02–042; C25B 1/55

See application file for complete search history.

(56) References Cited

U.S. PATENT DOCUMENTS

| | | | | |
|---|---|---|---|---|
| 7,618,612 | B2 | 11/2009 | Cortright et al. | |
| 7,943,805 | B2 | 5/2011 | Suppes et al. | |
| 2013/0269761 | A1 | 10/2013 | Ardo et al. | |
| 2018/0051379 | A1* | 2/2018 | Deutsch | C25B 11/075 |
| 2019/0055656 | A1 | 2/2019 | Kenis et al. | |
| 2019/0264338 | A1* | 8/2019 | Karp | C25B 9/73 |

(Continued)

FOREIGN PATENT DOCUMENTS

| | | | |
|---|---|---|---|
| EP | 1948582 | B1 | 12/2011 |
| JP | 2010285320 | A | 12/2010 |
| JP | 2011006298 | A | 1/2011 |

OTHER PUBLICATIONS

Schichtl et al., Electrooxidation of Glycerol on Self-Organized, Mixed Au—Pt Interfaces Formed on Ni Substrates, 167 J. of the Electrochem. Society 056502 (Year: 2020).*

(Continued)

*Primary Examiner* — Hosung Chung

(74) *Attorney, Agent, or Firm* — troutman pepper locke; Tim Tingkang Xia, Esq.

(57) ABSTRACT

One aspect of the invention provides a photoelectrochemical device including at least one electrochemical cell comprising an anode electrode and a cathode electrode; and a photovoltaic module integrated with the at least one electrochemical cell and adapted for converting energy of photons to electrical energy for driving the at least one electrochemical cell to facilitate redox reactions therein.

6 Claims, 20 Drawing Sheets

(56) References Cited

U.S. PATENT DOCUMENTS

2022/0042192 A1* 2/2022 Mitsuta ..... C25B 9/65
2024/0229257 A1* 7/2024 Monticelli ..... C25B 9/66

OTHER PUBLICATIONS

Yamaguchi, Original and Machine Translation, W.O. Int'l Pub. No. 2018/079103 A1 (Year: 2018).*
De Souza et al., Bi-modified Pt Electrodes toward Glycerol Electrooxidation in Alkaline Solution: Effects on Activity and Selectivity, 9 ACS Catal. 5104-10 (Year: 2019).*
Zhang et al., Selective electro-oxidation of glycerol to tartronate or mesoxalate on Au nanoparticle catalyst via electrode potential tuning in anion-exchange membrane electro-catalytic flow reactor, 147 Applied Catalysis B: Environmental 147 871 (Year: 2014).*
Sunpower. Maxeontm Gen II Solar Cells.
Ralph, E. L.; Linder, E. B. Advanced Solar Panel Designs. In Conference Record of the Twenty Fifth IEEE Photovoltaic Specialists Conference—1996; IEEE: Washington, DC, USA, 1996; pp. 297-300. https://doi.org/10.1109/PVSC.1996.564004.
Fedoroňko, M.; Königstein, J. Kinetics of Mutual Isomerization of Trioses and Their Dehydration to Methylglyoxal. Collect. Czechoslov. Chem. Commun. 1969, 34 (12), 3881-3894. https://doi.org/10.1135/cccc19693881.
Evans, W. L.; Cornthwaite, W. R. The Mechanism of Carbohydrate Oxidation. VII. The Action of Potassium Hydroxide on Dihydroxy Acetone. J. Am. Chem. Soc. 1928, 50 (2), 486-492. https://doi.org/10.1021/ja01389a036.
Bagheri, S.; Julkapli, N. M.; Yehye, W. A. Catalytic Conversion of Biodiesel Derived Raw Glycerol to Value Added Products. Renew. Sustain. Energy Rev. 2015, 41, 113-127. https://doi.org/10.1016/j.rser.2014.08.031.
Kimura, H. Oxidation Assisted New Reaction of Glycerol. Polym. Adv. Technol. 2001, 12 (11-12), 697-710. https://doi.org/10.1002/pat.91.
Carmo, M.; Fritz, D. L.; Mergel, J.; Stolten, D. A Comprehensive Review on PEM Water Electrolysis. Int. J. Hydrog. Energy 2013, 38 (12), 4901-4934. https://doi.org/10.1016/j.ijhydene.2013.01.151.
A. V. Tripkovič, K. Dj. Popović, R. M. Stevanovič, R. Socha, and A. Kowal, Activity of a PtBi Alloy in the Electrochemical Oxidation of Formic Acid, Electrochemistry Communications 8, 1492 (2006).
P. D. Vaidya and A. E. Rodrigues, Glycerol Reforming for Hydrogen Production: A Review, Chemical Engineering & Technology 32, 1463 (2009).
X. Lu, S. Xie, H. Yang, Y. Tong, and H. Ji, Photoelectrochemical Hydrogen Production from Biomass Derivatives and Water, Chemical Society Reviews 43, 7581 (2014).
L.-W. Huang, T.-G. Vo, and C.-Y. Chiang, Converting Glycerol Aqueous Solution to Hydrogen Energy and Dihydroxyacetone by the BiVO4 Photoelectrochemical Cell, Electrochimica Acta 322, 134725 (2019).
D. Liu, J.-C. Liu, W. Cai, J. Ma, H. B. Yang, H. Xiao, J. Li, Y. Xiong, Y. Huang, and B. Liu, Selective Photoelectrochemical Oxidation of Glycerol to High Value-Added Dihydroxyacetone, Nat Commun 10, 1 (2019).
M. S. E. Houache, R. Safari, U. O. Nwabara, T. Rafaideen, G. A. Botton, P. J. A. Kenis, S. Baranton, C. Coutanceau, and E. A. Baranova, Selective Electrooxidation of Glycerol to Formic Acid over Carbon Supported Ni1-x Mx (M= Bi, Pd and Au) Nano-Catalysts and Co-Electrolysis of CO2, Acs Appl. Energy Mater. (2020).
C. Liu, M. Hirohara, T. Maekawa, R. Chang, T. Hayashi, and C.-Y. Chiang, Selective Electro-Oxidation of Glycerol to Dihydroxyacetone by a Non-Precious Electrocatalyst—CuO, Applied Catalysis B: Environmental 265, 118543 (2020).
Walter, M. G.; Warren, E. L.; McKone, J. R.; Boettcher, S. W.; Mi, Q.; Santori, E. A.; Lewis, N. S. Solar Water Splitting Cells. Chem. Rev. 2010, 110 (11), 6446-6473. https://doi.org/10.1021/cr1002326.
Haussener, S.; Xiang, C.; Spurgeon, J. M.; Ardo, S.; Lewis, N. S.; Weber, A. Z. Modeling, Simulation, and Design Criteria for Photoelectrochemical Water-Splitting Systems. Energy Environ. Sci. 2012, 5 (12), 9922-9935. https://doi.org/10.1039/C2EE23187E.
Jiang, C.; Moniz, S. J. A.; Wang, A.; Zhang, T.; Tang, J. Photoelectrochemical Devices for Solar Water Splitting—Materials and Challenges. Chem. Soc. Rev. 2017, 46 (15), 4645-4660. https://doi.org/10.1039/C6CS00306K.
Bolton, J. R.; Strickler, S. J.; Connolly, J. S. Limiting and Realizable Efficiencies of Solar Photolysis of Water. Nature 1985, 316 (6028), 495-500. https://doi.org/10.1038/316495a0.
Brillet, J.; Yum, J.-H.; Cornuz, M.; Hisatomi, T.; Solarska, R.; Augustynski, J.; Graetzel, M.; Sivula, K. Highly Efficient Water Splitting by a Dual-Absorber Tandem Cell. Nat. Photonics 2012, 6 (12), 824-828. https://doi.org/10.1038/nphoton.2012.265.
Chen, Y.; Sun, K.; Audesirk, H.; Xiang, C.; Lewis, N. S. A Quantitative Analysis of the Efficiency of Solar-Driven Water-Splitting Device Designs Based on Tandem Photoabsorbers Patterned with Islands of Metallic Electrocatalysts. Energy Environ. Sci. 2015, 8 (6), 1736-1747. https://doi.org/10.1039/C5EE00311C.
Xiang, C.; Weber, A. Z.; Ardo, S.; Berger, A.; Chen, Y.; Coridan, R.; Fountaine, K. T.; Haussener, S.; Hu, S.; Liu, R.; Lewis, N. S.; Modestino, M. A.; Shaner, M. M.; Singh, M. R.; Stevens, J. C.; Sun, K.; Walczak, K. Modeling, Simulation, and Implementation of Solar-Driven Water-Splitting Devices. Angew. Chem. Int. Ed. 2016, 55 (42), 12974-12988. https://doi.org/10.1002/anie.201510463.
Hu, S.; Xiang, C.; Haussener, S.; Berger, A. D.; Lewis, N. S. An Analysis of the Optimal Band Gaps of Light Absorbers In Integrated Tandem Photoelectrochemical Water-Splitting Systems. Energy Environ. Sci. 2013, 6 (10), 2984-2993. https://doi.org/10.1039/C3EE40453F.
Verlage, E.; Hu, S.; Liu, R.; Jones, R. J. R.; Sun, K.; Xiang, C.; Lewis, N. S.; Atwater, H. A. A Monolithically Integrated, Intrinsically Safe, 10% Efficient, Solar-Driven Water-Splitting System Based on Active, Stable Earth-Abundant Electrocatalysts in Conjunction with Tandem III-V Light Absorbers Protected by Amorphous TiO2 Films. Energy Environ. Sci. 2015, 8 (11), 3166-3172. https://doi.org/10.1039/C5EE01786F.
Cheng, W.-H.; Richter, M. H.; May, M. M.; Ohlmann, J.; Lackner, D.; Dimroth, F.; Hannappel, T.; Atwater, H. A.; Lewerenz, H.-J. Monolithic Photoelectrochemical Device for Direct Water Splitting with 19% Efficiency. ACS Energy ett. 2018, 3 (8), 1795-1800. https://doi.org/10.1021/acsenergylett.8b00920.
Horowitz, K. A.; Remo, T. W.; Smith, B.; Ptak, A. J. A Techno-Economic Analysis and Cost Reduction Roadmap for III-V Solar Cells; NREL/TP--6A20-72103, 1484349; 2018; p NREL/TP-6A20-72103, 1484349. https://doi.org/10.2172/1484349.
Bornoz, P.; Abdi, F. F.; Tilley, S. D.; Dam, B.; van de Krol, R.; Graetzel, M.; Sivula, K. A Bismuth Vanadate-Cuprous Oxide Tandem Cell for Overall Solar Water Splitting. J. Phys. Chem. C 2014, 118 (30), 16959-16966. https://doi.org/10.1021/jp500441h.
Ahmet, I. Y.; Berglund, S.; Chemseddine, A.; Bogdanoff, P.; Präg, R. F.; Abdi, F. F.; Krol, R. van de. Planar and Nanostructured N-Si/Metal-Oxide/WO3/BiVO4 Monolithic Tandem Devices for Unassisted Solar Water Splitting. Adv. Energy Sustain. Res. 2020, 1 (2), 2000037. https://doi.org/10.1002/aesr.202000037.
Chen, Y.; Feng, X.; Liu, Y.; Guan, X.; Burda, C.; Guo, L. Metal Oxide-Based Tandem Cells for Self-Biased Photoelectrochemical Water Splitting. ACS Energy Lett. 2020, 5 (3), 844-866. https://doi.org/10.1021/ acsenergylett.9b02620.
Verma, S.; Lu, S.; Kenis, P. J. A. Co-Electrolysis of CO2 and Glycerol as a Pathway to Carbon Chemicals with Improved Technoeconomics Due to Low Electricity Consumption. Nat. Energy 2019, 4 (6), 466-474. https://doi.org/10.1038/s41560-019-0374-6.
Marshall, A. T.; Haverkamp, R. G. Production of Hydrogen by the Electrochemical Reforming of Glycerol-Water Solutions in a PEM Electrolysis Cell. Int. J. Hydrog. Energy 2008, 33 (17), 4649-4654. https://doi.org/10.1016/j.jhydene.2008.05.029.
Chen, Y. X.; Lavacchi, A.; Miller, H. A.; Bevilacqua, M.; Filippi, J.; Innocenti, M.; Marchionni, A.; Oberhauser, W.; Wang, L.; Vizza, F. Nanotechnology Makes Biomass Electrolysis More Energy Efficient than Water Electrolysis. Nat. Commun. 2014, 5, 4036. https://doi.org/10.1038/ncomms5036.

(56) References Cited

OTHER PUBLICATIONS

Gomes, J. F.; Tremiliosi-Filho, G. Spectroscopic Studies of the Glycerol Electro-Oxidation on Polycrystalline Au and Pt Surfaces in Acidic and Alkaline Media. Electrocatalysis 2011, 2 (2), 96-105. https://doi.org/10.1007/s12678-011-0039-0.
Simões, M.; Baranton, S.; Coutanceau, C. Enhancement of Catalytic Properties for Glycerol Electrooxidation on Pt and Pd Nanoparticles Induced by Bi Surface Modification. Appl. Catal. B Environ. 2011, 110, 40-49. https://doi.org/10.1016/j.apcatb.2011.08.020.
Simões, M.; Baranton, S.; Coutanceau, C. Electrochemical Valorisation of Glycerol. ChemSusChem 2012, 5 (11), 2106-2124. https://doi.org/10.1002/cssc.201200335.
Coutanceau, C.; Baranton, S.; Kouamé, R. S. B. Selective Electrooxidation of Glycerol Into Value-Added Chemicals: A Short Overview. Front. Chem. 2019, 7, 100. https://doi.org/10.3389/fchem.2019.00100.
Yang, F.; Hanna, M. A.; Sun, R. Value-Added Uses for Crude Glycerol—a Byproduct of Biodiesel Production. Biotechnol. Biofuels 2012, 5 (1), 13. https://doi.org/10.1186/1754-6834-5-13.
Da Silva, R. G.; Aquino Neto, S.; Kokoh, K. B.; De Andrade, A. R. Electroconversion of Glycerol in Alkaline Medium: From Generation of Energy to Formation of Value-Added Products. J. Power Sources 2017, 351, 174-182. https://doi.org/10.1016/j.jpowsour.2017.03.101.
Sathre, R.; Scown, C. D.; Morrow, W. R.; Stevens, J. C.; Sharp, I. D.; Ager, J. W.; Walczak, K.; Houle, F. A.; Greenblatt, J. B. Life-Cycle Net Energy Assessment of Large-Scale Hydrogen Production via Photoelectrochemical Water Splitting. Energy Environ. Sci. 2014, 7 (10), 3264-3278. https://doi.org/10.1039/C4EE01019A.
Dai, C.; Sun, L.; Liao, H.; Khezri, B.; Webster, R. D.; Fisher, A. C.; Xu, Z. J. Electrochemical Production of Lactic Acid from Glycerol Oxidation Catalyzed by AuPt Nanoparticles. J. Catal. 2017, 356, 14-21. https://doi.org/10.1016/j.icat.2017.10.010.
Schichtl, Z. G.; Mehrabi, H.; Coridan, R. H. Electrooxidation of Glycerol on Self-Organized, Mixed Au—Pt Interfaces Formed on Ni Substrates. J. Electrochem. Soc. 2020, 167 (5), 056502. https://doi.org/10.1149/1945-7111/ab679e.
Greeley, J.; Stephens, I. E. L.; Bondarenko, A. S.; Johansson, T. P.; Hansen, H. A.; Jaramillo, T. F.; Rossmeisl, J.; Chorkendorff, I.; Nørskov, J. K. Alloys of Platinum and Early Transition Metals as Oxygen Reduction Electrocatalysts. Nat. Chem. 2009, 1 (7), 552-556. https://doi.org/10.1038/nchem.367.
Li, M.; Duanmu, K.; Wan, C.; Cheng, T.; Zhang, L.; Dai, S.; Chen, W.; Zhao, Z.; Li, P.; Fei, H.; Zhu, Y.; Yu, R.; Luo, J.; Zang, K.; Lin, Z.; Ding, M.; Huang, J.; Sun, H.; Guo, J.; Pan, X.; Goddard, W. A.; Sautet, P.; Huang, Y.; Duan, X. Single-Atom Tailoring of Platinum Nanocatalysts for High-Performance Multifunctional Electrocatalysis. Nat. Catal. 2019, 2 (6), 495-503. https://doi.org/10.1038/s41929-019-0279-6.
Wu, Z.-P.; Shan, S.; Zang, S.-Q.; Zhong, C.-J. Dynamic Core-Shell and Alloy Structures of Multimetallic Nanomaterials and Their Catalytic Synergies. Acc. Chem. Res. 2020, 53 (12), 2913-2924. https://doi.org/10.1021/acs.accounts.0c00564.
Wu, Z.-P.; Caracciolo, D. T.; Maswadeh, Y.; Wen, J.; Kong, Z.; Shan, S.; Vargas, J. A.; Yan, S.; Hopkins, E.; Park, K.; Sharma, A.; Ren, Y.; Petkov, V.; Wang, L.; Zhong, C.-J. Alloying-Realloying Enabled High Durability for Pt—Pd-3d-Transition Metal Nanoparticle Fuel Cell Catalysts. Nat. Commun. 2021, 12 (1), 859. https://doi.org/10.1038/s41467-021-21017-6.
Kwon, Y.; Birdja, Y.; Spanos, I.; Rodriguez, P.; Koper, M. T. M. Highly Selective Electro-Oxidation of Glycerol to Dihydroxyacetone on Platinum in the Presence of Bismuth. ACS Catal. 2012, 2 (5), 759-764. https://doi.org/10.1021/cs200599g.
Garcia, A. C.; Birdja, Y. Y.; Tremiliosi-Filho, G.; Koper, M. T. M. Glycerol Electro-Oxidation on Bismuth-Modified Platinum Single Crystals. J. Catal. 2017, 346, 117-124. https://doi.org/10.1016/j.jcat.2016.12.013.
De Souza, M. B. C.; Vicente, R. A.; Yukuhiro, V. Y.; V. M. T. Pires, C. T. G.; Cheuquepán, W.; Bott-Neto, J. L.; Solla-Gullon, J.; Fernández, P. S. Bi-Modified Pt Electrodes toward Glycerol Electrooxidation in Alkaline Solution: Effects on Activity and Selectivity. ACS Catal. 2019, 9 (6), 5104-5110. https://doi.org/10.1021/acscatal.9b00190.
Brandner, A.; Lehnert, K.; Bienholz, A.; Lucas, M.; Claus, P. Production of Biomass-Derived Chemicals and Energy: Chemocatalytic Conversions of Glycerol. Top. Catal. 2009, 52 (3), 278-287. https://doi.org/10.1007/s11244-008-9164-2.
Villa, A.; Campisi, S.; Chan-Thaw, C. E.; Motta, D.; Wang, D.; Prati, L. Bismuth Modified Au—Pt Bimetallic Catalysts for Dihydroxyacetone Production. Catal. Today 2015, 249, 103-108. https://doi.org/10.1016/j.cattod.2014.12.012.
Motta, D.; Trujillo, F. J. S.; Dimitratos, N.; Villa, A.; Prati, L. An Investigation on AuPt and AuPt—Bi on Granular Carbon as Catalysts for the Oxidation of Glycerol under Continuous Flow Conditions. Catal. Today 2018, 308, 50-57. https://doi.org/10.1016/j.cattod.2017.10.012.
Velázquez-Hernández, I.; Zamudio, E.; Rodriguez-Valadez, F. J.; García-Gómez, N. A.; Álvarez-Contreras, L.; Guerra-Balcázar, M.; Arjona, N. Electrochemical Valorization of Crude Glycerol in Alkaline Medium for Energy Conversion Using Pd, Au and PdAu Nanomaterials. Fuel 2020, 262, 116556. https://doi.org/10.1016/j.fuel.2019.116556.
Coridan, R. H.; Nielander, A. C.; Francis, S. A.; McDowell, M. T.; Dix, V.; Chatman, S. M.; Lewis, N. S. Methods for Comparing the Performance of Energy-Conversion Systems for Use in Solar Fuels and Solar Electricity Generation. Energy Environ. Sci. 2015, 8 (10), 2886-2901. https://doi.org/10.1039/C5EE00777A.
Hu, S.; Luo, X.; Wan, C.; Li, Y. Characterization of Crude Glycerol from Biodiesel Plants. J. Agric. Food Chem. 2012, 60 (23), 5915-5921. https://doi.org/10.1021/jf3008629.
Liu, Y.; Yu, W.; Raciti, D.; Gracias, D. H.; Wang, C. Electrocatalytic Oxidation of Glycerol on Platinum. J. Phys. Chem. C 2019, 123 (1), 426-432. https:/doi.org/10.1021/acs.jpcc.8b08547.
Pourbaix, M. Atlas of Electrochemical Equilibria in Aqueous Solution. NACE 1974, 307.
Burke, L. D.; Nugent, P. F. The Electrochemistry of Gold: I the Redox Behaviour of the Metal in Aqueous Media. Gold Bull. 1997, 30 (2), 43-53. https://doi.org/10.1007/BF03214756.
Burke, L. D.; Nugent, P. F. The Electrochemistry of Gold: II the Electrocatalytic Behaviour of the Metal in Aqueous Media. Gold Bull. 1998, 31 (2), 39-50. https://doi.org/10.1007/BF03214760.
Burke, L. D.; Collins, J. A.; Horgan, M. A.; Hurley, L. M.; O'Mullane, A. P. The Importance of the Active States of Surface Atoms with Regard to the Electrocatalytic Behaviour of Metal Electrodes in Aqueous Media. Electrochimica Acta 2000, 45 (25), 4127-4134. https://doi.org/10.1016/S0013-4686(00)00532-6.
Burke, L. D.; Moran, J. M.; Nugent, P. F. Cyclic Voltammetry Responses of Metastable Gold Electrodes in Aqueous Media. J. Solid State Electrochem. 2003, 7 (9), 529-538. https://doi.org/10.1007/s10008-003-0359-y.
Burke, L. D. Scope for New Applications for Gold Arising from the Electrocatalytic Behaviour of Its Metastable Surface States. Gold Bull. 2004, 37 (1), 125-135. https://doi.org/10.1007/BF03215520.
Kwon, Y.; Lai, S. C. S.; Rodriguez, P.; Koper, M. T. M. Electrocatalytic Oxidation of Alcohols on Gold in Alkaline Media: Base or Gold Catalysis? J. Am. Chem. Soc. 2011, 133 (18), 6914-6917. https://doi.org/10.1021/ja200976j.
Oliveira, V. L.; Morais, C.; Servat, K.; Napporn, T. W.; Tremiliosi-Filho, G.; Kokoh, K. B. Glycerol Oxidation on Nickel Based Nanocatalysts in Alkaline Medium—Identification of the Reaction Products. J. Electroanal. Chem. 2013, 703, 56-62. https://doi.org/10.1016/j.jelechem.2013.05.021.
Moulder, J. F.; Stickle, W. F.; Sobol, P. E.; Bomben, K. D. Handbook of X Ray Photoelectron Spectroscopy: A Reference Book of Standard Spectra for Identification and Interpretation of Xps Data; Physical Electronics: Eden Prairie, Minn., 1995.
Wang, D.; Cui, X.; Xiao, Q.; Hu, Y.; Wang, Z.; Yiu, Y. M.; Sham, T. K. Electronic Behaviour of Au—Pt Alloys and the 4f Binding Energy Shift Anomaly in Au Bimetallics-X-Ray Spectroscopy Stud-

(56) References Cited

OTHER PUBLICATIONS ies. AIP Adv. 2018, 8 (6), 065210. https://doi.org/10.1063/1.5027251.

* cited by examiner

DEVICES AND METHODS FOR ELECTROCATALYTIC HYDROGEN PRODUCTION

CROSS-REFERENCE TO RELATED PATENT APPLICATION

This application claims priority to and the benefit of U.S. Provisional Patent Application Ser. No. 63/218,963, filed Jul. 7, 2021, which is incorporated herein in its entirety by reference.

STATEMENT AS TO RIGHTS UNDER FEDERALLY-SPONSORED RESEARCH

This invention was made with government support under grant numbers DE-SC0020301 awarded by the Department of Energy. The government has certain rights in the invention.

FIELD OF THE INVENTION

This invention relates generally to electrocatalysis, and more particularly to devices and methods for electrocatalytic hydrogen production from glycerol.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

Glycerol is the biproduct of the transesterification of triglycerides in biodiesel production. 4 million metric tons of glycerol are projected from biodiesel production in 2020, resulting in a considerable oversupply for traditional glycerol applications like cosmetics and soaps. Researchers are targeting chemical methods for the valorization of glycerol to commodity chemicals. Due to its availability, glycerol electrooxidation has recently been implemented to reduce overall electrochemical cell voltages for aqueous phase, fuel-forming cathodic reactions such as hydrogen evolution and carbon dioxide reduction. Other processes and methods for the valorization of glycerol may also be relevant.

Therefore, a heretofore unaddressed need exists in the art to address the aforementioned deficiencies and inadequacies.

SUMMARY OF THE INVENTION

In one aspect, this invention relates to a photoelectrochemical device comprising at least one electrochemical cell comprising an anode electrode and a cathode electrode; and a photovoltaic module integrated with the at least one electrochemical cell and adapted for converting energy of photons to electrical energy for driving the at least one electrochemical cell to facilitate redox reactions therein.

In one embodiment, the anode electrode comprises a substrate and a metal-based electrocatalyst formed on the substrate.

In one embodiment, the metal-based electrocatalyst comprises Au, Pt, Pd, or other noble metals and/or transition metals including but not limited to Bi.

In one embodiment, the metal-based electrocatalyst is formed on the substrate in a single layer structure, or a multilayered structure.

In one embodiment, the substrate comprises a current collecting electrode conformally coated with the metal-based electrocatalyst In one embodiment, the photovoltaic module comprises photon absorbers formed with single or multiple junctions.

In one embodiment, the photon absorbers comprise multiple layers with each formed of a different semiconductor.

In one embodiment, the multiple layers are stacked on the top of each other in a tandem configuration.

In one embodiment, the photovoltaic module comprises one or more photovoltaic cells.

In one embodiment, the at least one electrochemical cell further comprises an anode compartment, a cathode compartment, and an anion exchange membrane separating the anode compartment and the cathode compartment, wherein each of the anode compartment and the cathode compartment contains a same electrolyte, or a different electrolyte.

In one embodiment, the electrolyte contains glycerol.

In one embodiment, the at least one electrochemical cell is configured to generate hydrogen from glycerol oxidation at a cell potential that is significantly smaller than that for water splitting.

In another aspect, the invention relates to a photoelectrochemical device comprising at least one electrochemical cell comprising an anode electrode and a cathode electrode, wherein at least one of the anode electrode and the cathode electrode is a photoelectrode configured, when illuminated with light, to initiate photoelectrochemical oxidation/reduction reactions in the at least one electrochemical cell.

In one embodiment, the anode electrode comprises a substrate and a metal-based electrocatalyst formed on the substrate.

In one embodiment, the metal-based electrocatalyst comprises Au, Pt, Pd, or other noble metals and/or transition metals including Bi.

In one embodiment, the metal-based electrocatalyst is formed on the substrate in a single layer structure, or a multilayered structure.

In one embodiment, the substrate comprises a current collecting electrode conformally coated with the metal-based electrocatalyst. In one embodiment, the substrate comprises Ni.

In one embodiment, the photoelectrode comprises a photovoltage-generating component made from inorganic, organic, or mixed photovoltaics.

In one embodiment, the at least one electrochemical cell further comprises an anode compartment, a cathode compartment, and an anion exchange membrane separating the anode compartment and the cathode compartment, wherein each of the anode compartment and the cathode compartment contains a same electrolyte, or a different electrolyte.

In one embodiment, the electrolyte contains glycerol.

In one embodiment, the at least one electrochemical cell is configured to generate hydrogen from glycerol oxidation at a cell potential that is significantly smaller than that for water splitting.

In yet another aspect, the invention relates to an electrochemical device comprising at least one electrochemical cell comprising an anode electrode and a cathode electrode; and a source of electricity for providing a potential between the anode electrode and the cathode electrode for driving the at least one electrochemical cell to facilitate redox reactions therein.

In one embodiment, the anode electrode comprises a substrate and a metal-based electrocatalyst formed on the substrate.

In one embodiment, the metal-based electrocatalyst comprises Au, Pt, Pd, or other noble metals and/or transition metals including Bi.

In one embodiment, the metal-based electrocatalyst is formed on the substrate in a single layer structure, or a multilayered structure.

In one embodiment, the substrate comprises a current collecting electrode conformally coated with the metal-based electrocatalyst. In one embodiment, the substrate comprises Ni.

In one embodiment, at least one of the anode electrode and the cathode electrode is a photoelectrode configured to initiate photoelectrochemical redox reactions.

In one embodiment, the photoelectrode comprises a photovoltage-generating component made from inorganic, organic, or mixed photovoltaics.

In one embodiment, the source of electricity comprises one or more photovoltaic cells for converting energy of photons to electrical energy.

In one embodiment, the at least one electrochemical cell further comprises an anode compartment, a cathode compartment, and an anion exchange membrane separating the anode compartment and the cathode compartment, wherein each of the anode compartment and the cathode compartment contains a same electrolyte, or a different electrolyte.

In one embodiment, the electrolyte contains glycerol.

In one embodiment, the at least one electrochemical cell is configured to generate hydrogen from glycerol oxidation at a cell potential that is significantly smaller than that for water splitting.

In one aspect, the invention relates to a method for valorization of glycerol comprising: providing at least one photoelectrochemical cell comprising an electrolyte containing glycerol, an anode electrode and a cathode electrode, wherein at least one of the anode electrode and the cathode electrode is a photoelectrode; and illuminating the at least one photoelectrochemical cell with light so that the photoelectrode initiates photoelectrochemical redox reactions to promote electrocatalytic reactions in the at least one electrochemical cell, thereby generating hydrogen from glycerol oxidation.

In one embodiment, the anode electrode comprises a metal-based electrocatalyst.

In one embodiment, the metal-based electrocatalyst comprises Au, Pt, Pd, or other noble metals and/or transition metals including Bi.

In one embodiment, the photoelectrode comprises a photovoltage-generating component made from inorganic, organic, or mixed photovoltaics.

These and other aspects of the present invention will become apparent from the following description of the preferred embodiments, taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. The same reference numbers may be used throughout the drawings to refer to the same or like elements in the embodiments.

DETAILED DESCRIPTION OF THE INVENTION

Figure 1:
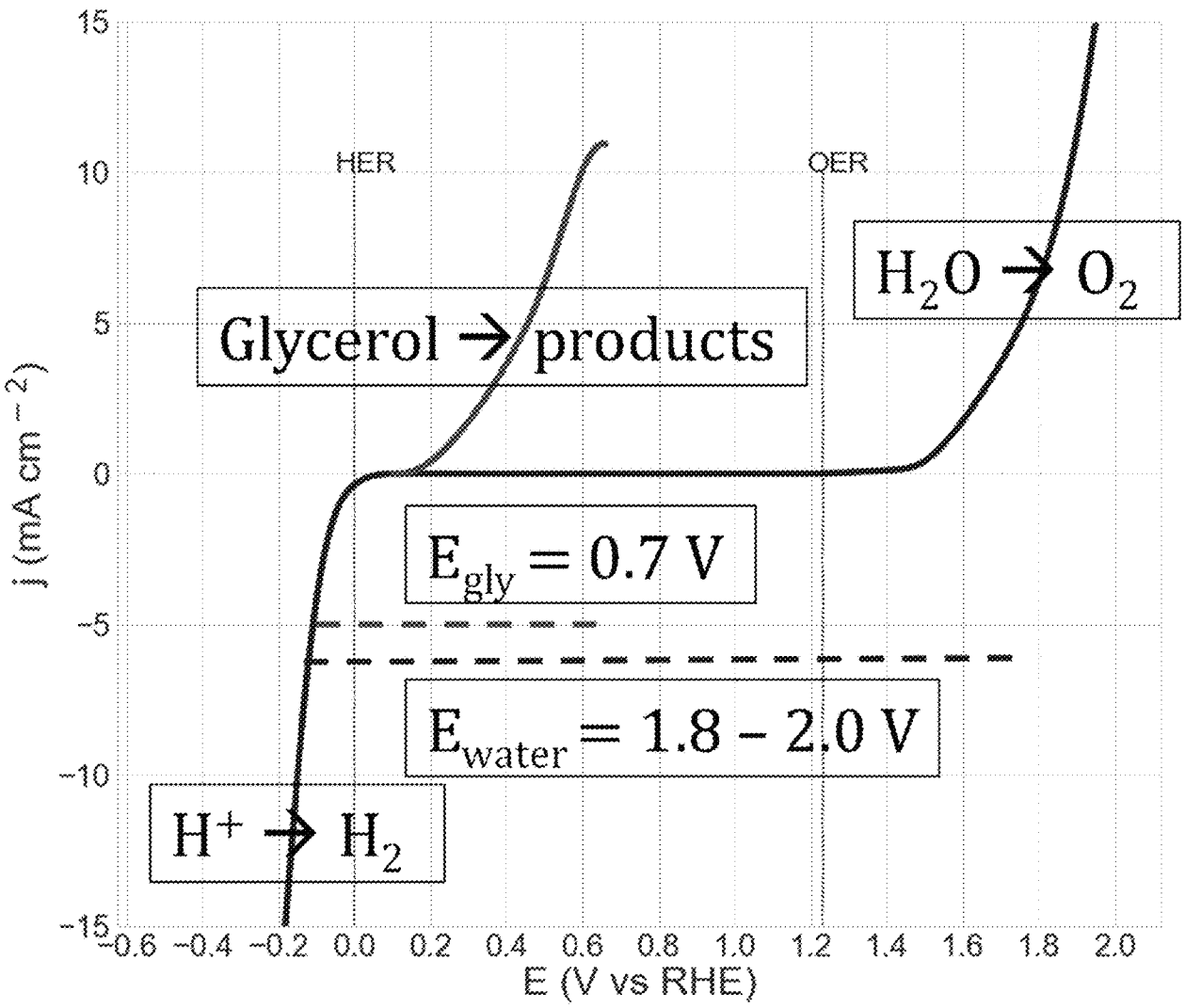
FIG. 1 shows comparison of the cell potential (energy) required for water splitting and oxidizing glycerol. The energy required to drive water splitting determined not just by the thermodynamics of the products, but also the kinetics. As a result, the amount of voltage required to generate hydrogen and oxygen from water splitting is greater than 1.8V at best. Thermodynamically, the limit is 1.23V. Glycerol (a.k.a. glycerine) is a byproduct of biodiesel synthesis and cheap feedstock with a need for valorization (dihydroxyacetone, glyceraldehyde). The electrocatalyst we have developed in the invention lowers the cell potential for oxidizing glycerol, generating hydrogen at minimum of 0.4 V of cell potential and 0.75 V practical current densities (compared to water splitting at >1.8V). This results in a significant decrease in the amount of photovoltage required for solar-to-hydrogen "artificial leaf", simpler systems with a single light absorber, lowering energy payback time and increasing rates. Based on the market price of crude glycerol \$0.20-0.50/kg, oxidizing glycerol completely to $CO_2$ can potentially achieve $H_2$ price targets of <\$2/kg.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this invention will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed may be resorted to by those skilled in the art, and that such modifications and variations are considered to be within the scope of this invention as defined by the appended claims.

Whenever a range is given in the specification, for example, a temperature range, a time range, or a composition or concentration range, all intermediate ranges and subranges, as well as all individual values included in the ranges given are intended to be included in the invention. It will be understood that any subranges or individual values in a range or subrange that are included in the description herein can be excluded from the claims herein.

It will be understood that, as used in the description herein and throughout the claims that follow, the meaning of "a", "an", and "the" includes plural reference unless the context clearly dictates otherwise. Thus, for example, reference to "a cell" includes a plurality of such cells and equivalents thereof known to those skilled in the art. As well, the terms "a" (or "an"), "one or more" and "at least one" can be used interchangeably herein. It is also to be noted that the terms "comprising", "including", and "having" can be used interchangeably.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising", or "includes" and/or "including", or "has" and/or "having", or "carry" and/or "carrying", or "contain" and/or "containing", or "involve" and/or "involving", "characterized by", and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

As used in the disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in the disclosure, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

This invention focuses generally on electrochemical and photoelectrochemical materials for converting the energy of sunlight to fuels. One of the most promising reactions is the solar-driven generation of hydrogen from splitting water. This can be done by photovoltaics coupled to an electrolyzer (generating $H_2$ and $O_2$) or by an "artificial leaf" device that assembles electrocatalyst layer(s), semiconductor layer(s), and membrane(s) into a photoelectrochemical cell. Used in the disclosure, the term "artificial leaf" may refer to a process or device can turn the energy of sunlight directly into a chemical fuel that can be stored and used later as an energy source.

Hydrogen generated from solar photovoltaic (PV) driven electrolysis and photoelectrochemical (PEC) water splitting are particularly attractive alternatives to fossil fuels. This is due to the ubiquity of the renewable inputs (water and sunlight) and the carbon-free output of the exergonic reaction between $H_2$ and $O_2$ to form water. Integrated systems for unassisted, solar-driven water splitting must generate sufficient photovoltage to overcome the thermodynamic potential difference between the hydrogen evolution reaction (HER) and oxygen evolution reaction (OER), kinetic overpotentials related to each reaction, and other practical system losses. A single semiconductor with band edges appropriate for driving HER and OER, a small band gap to maximize light absorption, and robust chemical stability would be particularly convenient for constructing photoelectrodes for water splitting. However, a material with this combination of properties has yet to be identified. To overcome this limitation, tandem or multijunction-based photoelectrodes can be arranged in series to generate the sufficient photovoltage required to drive the overall reaction while increasing the total achievable photocurrent. A significant body of research has focused on the system design of tandem photoelectrodes aiming to identify the optimal combination of materials given the limitations of insolation, electrocatalytic overpotentials, or other practical considerations. Assuming state-of-the-art performance from the functional components, the maximal solar-to-hydrogen (STH) efficiency for a two-absorber tandem water splitting device under one-sun illumination is 29.3%, corresponding to a current density of 23.8 mA $cm^{-2}$. Prototypical systems based on high-performance, multijunction semiconductor stacks (III-V solar cells, for example) are able to reach practical STH efficiencies in unassisted configurations (up to 20%). However, scalability is a major issue for these materials in STH applications. Other systems show that unassisted water splitting is possible for earth abundant semiconductors such as Si, $Cu_2O$, $Fe_2O_3$, and $BiVO_4$, though experimental efficiencies are currently lower than practical targets. Complex arrangements of the electrocatalysts, light absorbers, and other functional components and the relevant, complex multistep fabrications processes are unavoidable for unassisted, solar-driven water splitting photoelectrodes.

The use of sacrificial molecules to fuel the oxidation reaction at the anode can reduce the overall cell potential, thus reducing the need for tandem light absorbers and simplifying the design of an integrated system for solar-driven hydrogen evolution. A single absorber configuration maximizes the ceiling for the areal-normalized rate of HER compared to a multijunction stack, which is limited by requirements for matching photocurrents in each layer. Glycerol is electrochemically easier to oxidize than water (to $O_2$) and is a waste stream for the biodiesel industry looking for routes to valorization, and has recently drawn interest as a replacement oxidant for water on the anode for reducing required cell potentials in electrolytic $CO_2$ reduction or water electrolysis devices. Glycerol electrooxidation occurs at more negative applied potentials than the OER potential on a number of electrocatalysts and in a range of aqueous solvents. Crude glycerol (high concentration glycerol in alkaline solution plus impurities) is a particularly attractive target as it is the direct byproduct of biodiesel synthesis and target for further valorization strategies. Utilizing glycerol as a sacrificial oxidant could simplify PEC solar-to-hydrogen device design, mitigating the impact of fueling the reaction with a significant improvement in the energy payback time compared to a full water-splitting integrated system.

Noble metal (Pt, Pd, Au, etc.) electrocatalysts have been studied extensively for the glycerol electrooxidation reaction. Mixed Au—Pt electrocatalysts have shown the ability to prolong the activity and reduce the applied potential required to oxidize glycerol in alkaline conditions versus Au or Pt alone. X-ray photoelectron spectroscopy studies suggest that the Au—Pt composite affects the electronic structure of the Pt in a way that promotes electrocatalytic activity. Transition metals are added to the surfaces of noble metal electrocatalysts to facilitate alcohol electrooxidation by increasing rates, prolonging activity, or tailoring selectivity. Bi has been used to modify Pt electrocatalysts for glycerol electrooxidation, where it provides surface-bound hydroxide for the oxidation of active site-blocking adsorbates on the Pt. Pt/Bi systems have shown reduced catalytic activity over time as glycerol can leach Bi during the reaction. We hypothesized that the glycerol electrooxidation activity and stability of Pt electrocatalysts, can be enhanced by the cooperative effects of Au and Bi simultaneously. The introduction of Au affects the electronic structure of Pt to improve its electrocatalytic activity and stability. Bi provides adsorbed hydroxide ($OH_{ads}$) species to readily remove adsorbed organics on the Pt, preventing poisoning of active sites for glycerol oxidation. The addition of AuPt nanoparticles on carbon support have been previously reported for catalytic glycerol conversion in acidic conditions. Pd, Au, and PdAu nanoparticles on C support have also been used to electrooxidize crude glycerol, though high activity ended within a few minutes under potentiostatic electrolysis.

We have recently developed an Au—Pt catalyst system that can improve the oxidation of glycerol over the monometallic electrocatalysts. Au is more stable than Pt, but requires a higher applied potential for the same current density. We found a simple approach to synthesizing these electrocatalysts and then characterized the performance to find that the longevity of an electrode that performed like Pt has been improved. We also noted some electronic effects that could explain the observation of improved electrocatalysis on the mixed-metal electrodes. In addition, it is shown that Pt—Bi mixed metal electrocatalysts may reduce the applied potential required for glycerol oxidation. However, the Pt—Bi electrode cannot last long before it degrades (Pt-oxide formation presumed) and thus can no longer oxidize glycerol.

The invention in certain aspects discloses an approach to replace the OER half-reaction with the sacrificial crude glycerol electrooxidation on a layered Au—Pt—Bi electrocatalyst on a Ni substrate. Compared to compositions with fewer components, the AuPtBi—Ni electrocatalyst improved the duration of performance and reduced the overall cell potential for glycerol electrooxidation in the extreme alkaline solutions representative of crude glycerol. These enhancements facilitated extended, unassisted hydrogen evolution from crude glycerol electrolysis, even under the power of a single-junction silicon solar cell at less than one-sun illumination. We characterized the oxidation products of crude glycerol electrolysis and the subsequent products formed spontaneously in the electrolyte in the highly alkaline solution. This analysis helps to both identify the stoichiometric limits of glycerol oxidation at the low cell potentials of interest here and to understand the chemical control imparted by electrocatalysis on the ultimate compounds formed in the crude solution. The results for the AuPtBi electrocatalyst show that incorporating crude glycerol oxidation into integrated electrochemical systems can simultaneously simplify their design and significantly improve solar-to-hydrogen rates.

In some embodiments, the approach utilizes a scalable Au—Pt—Bi electrocatalyst system that can reduce the amount of energy required to generate hydrogen from solar energy when using glycerol as a fuel. In some embodiments, a single Si solar cell ($E_{cell}$<0.630 V) can provide enough voltage to generate $H_2$ from glycerol for days, where at least 1.7 V is required for the direct splitting of water (FIG. 1). More importantly, this catalyst can reduce the system costs and complexity required to construct an "artificial leaf", as it reduces the number of semiconductor junctions required to generate the lower voltage for solar-to-hydrogen energy conversion using glycerol. In some embodiments, a solar-to-hydrogen photoelectrochemical device is built from a single semiconductor. Glycerol is a waste product of the biodiesel industry, so this invention contributes to the economics of biodiesel formation as well. Based on the market price of crude glycerol \$0.20-0.50/kg, oxidizing glycerol completely to $CO_2$ can potentially achieve $H_2$ price targets of <\$2/kg.

In some embodiments, the scalable Au—Pt—Bi electrocatalyst system combines the Au—Pt electrocatalyst with a thin layer of electrodeposited Bi (roughly monolayer of Bi), which results in extremely long-lived glycerol oxidation (several days) with cell voltages below 600 mV for low, but practical current densities (about 10 mA $cm^{-2}$). In some embodiments, a single Si solar cell (generating 600-630 mV cell potential at open circuit) can generate hydrogen in series with a glycerol electrolyzer, with 100% of the current going towards $H_2$ evolution rather than electrode degradation. This threshold is also important because it means that a single semiconductor (0.8-1.0V) can generate sufficient photovoltages and photocurrents to generate $H_2$ at high current densities (>30 mA $cm^{-2}$) under solar illumination. The practical target for an "artificial leaf" device is 10 mA $cm^{-2}$ for a practicable photoelectrochemical device in direct sunlight. While glycerol may be fueling this reaction, it is also simplifying the device design, decreasing the costs, and improving the viability of the "artificial leaf" design as a whole. It may also avoid the need for a membrane, as glycerol oxidation product crossover may be inert to reduction on the cathode.

Figure 2:
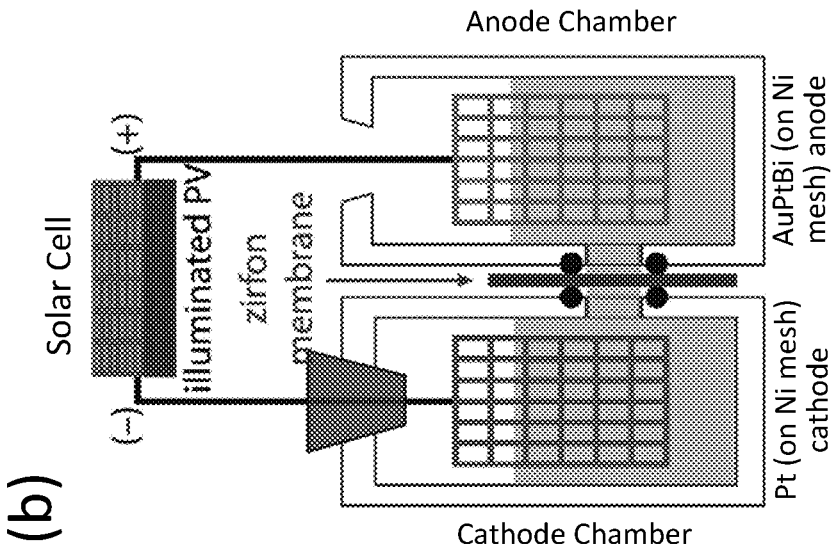
FIG. 2 shows an electrochemical device for $H_2$ generation from glycerol using a monocrystalline Si solar panel (operating at <1 sun illumination, 0.620 V open circuit=maximum voltage output), according to embodiments of the invention. Panel (a): An exemplary experiment setup, Panel (b): A schematic diagram. The photoelectrochemical device includes an anode chamber, a cathode chamber, a Zirfon membrane separating the anode chamber and the cathode chamber, a Ni based AuPtBi anode electrode placed in the anode chamber, a Ni based Pt cathode electrode placed in the cathode chamber, and a single monocrystalline Si solar cell coupled to between the Ni based AuPtBi anode electrode and the Ni based Pt cathode electrode for converting energy of photons to electrical energy for driving the electrochemical cell to generate $H_2$. Both the anode and cathode chamber contains a crude glycerol model electrolyte. This monocrystalline Si solar cell cannot split water to produce $H_2$, which needs greater than 1.8V open circuit, but can generate hydrogen with a glycerol electrolyzer by utilizing the metal-based electrocatalyst according to the invention.
Figure 2:
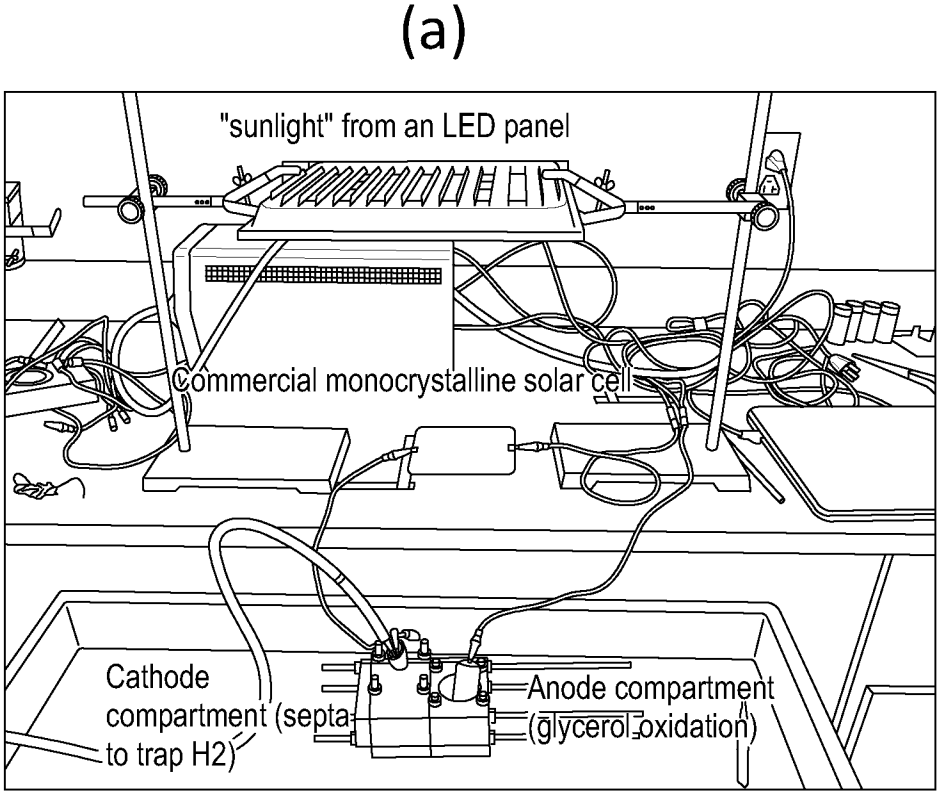

FIG. 2 shows an exemplary embodiment of an electrochemical device for $H_2$ generation from glycerol using a monocrystalline Si solar panel (operating at <1 sun illumination, 0.620 V open circuit=maximum voltage output). The photoelectrochemical device includes an anode chamber, a cathode chamber, a Zirfon membrane separating the anode chamber and the cathode chamber, a Ni based AuPtBi anode electrode placed in the anode chamber, a Ni based Pt cathode electrode placed in the cathode chamber, and a single monocrystalline Si solar cell coupled to between the Ni based AuPtBi anode electrode and the Ni based Pt cathode electrode for converting energy of photons to electrical energy for driving the electrochemical cell to generate $H_2$. Both the anode and cathode chamber contains a crude glycerol model electrolyte. This monocrystalline Si solar cell cannot split water to produce $H_2$, which needs greater than 1.8V open circuit, but is sufficient to generate $H_2$ from glycerol by utilizing the metal-based electrocatalyst according to the invention.

Figure 3:
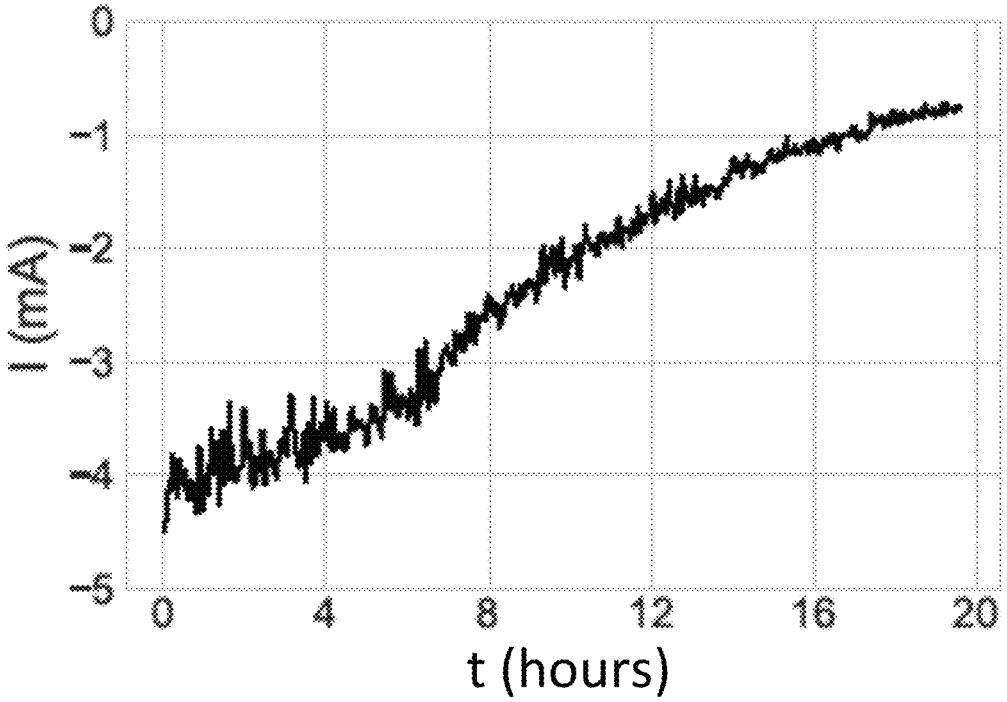
FIG. 3 shows $H_2$ generation with a single Si solar cell with low currents according to embodiments of the invention. All current goes to making $H_2$ (bottom plot, charge passed "theoretical" versus $H_2$ measured by gas chromatography "measured").
Figure 3:
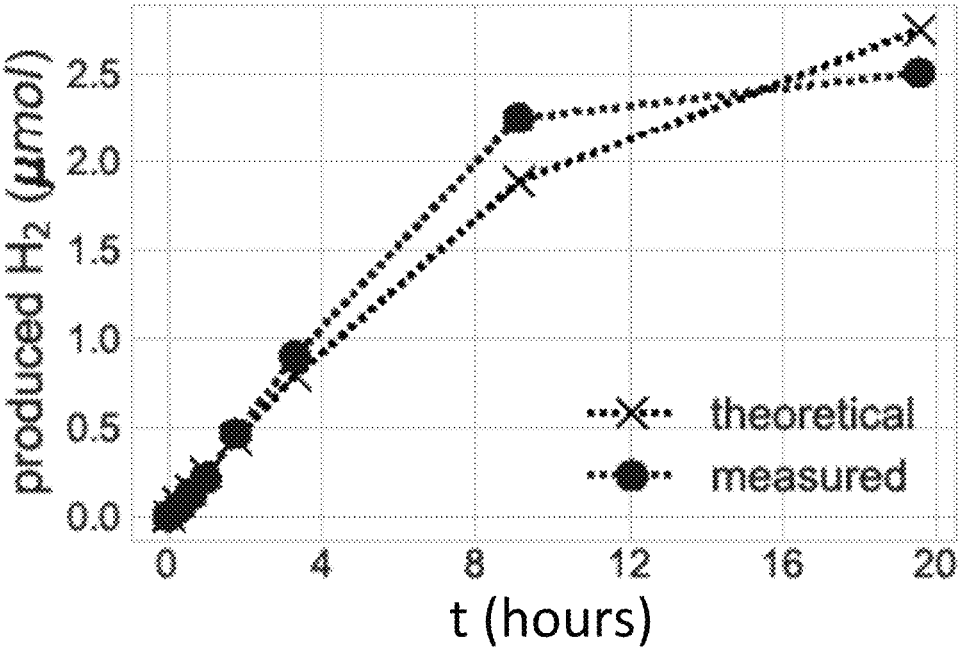

FIG. 3 shows $H_2$ generation with a single Si solar cell with low currents according to embodiments of the invention. All current goes to making $H_2$ (bottom plot, charge passed "theoretical" versus $H_2$ measured by gas chromatography "measured"). In other embodiments, we have also demonstrated $H_2$ generation with a single GaAs solar cell ($V_0$=0.950 V) and greater stability (steady currents for >24 hrs).

Without intent to limit the scope of the invention, provided herein are representative aspects and embodiments of the invention.

Certain aspects of the invention discloses to a photoelectrochemical device comprising at least one electrochemical cell comprising an anode electrode and a cathode electrode; and a photovoltaic module integrated with the at least one electrochemical cell and adapted for converting energy of photons to electrical energy for driving the at least one electrochemical cell to facilitate redox reactions therein.

In some embodiments, the at least one electrochemical cell further comprises an anode compartment, a cathode compartment, and an anion exchange membrane separating the anode compartment and the cathode compartment. Each of the anode compartment and the cathode compartment contains a same electrolyte, or a different electrolyte.

In some embodiments, the anode electrode comprises a substrate and a metal-based electrocatalyst formed on the substrate. In some embodiments, the metal-based electrocatalyst comprises Au, Pt, Pd, or other noble metals and/or transition metals including but not limited to Bi. In some embodiments, the metal-based electrocatalyst is formed on the substrate in a single layer structure, or a multilayered structure. In some embodiments, the substrate comprises a current collecting electrode conformally coated with the metal-based electrocatalyst. In one embodiment, the substrate comprises Ni.

In some embodiments, the photovoltaic module comprises photon absorbers formed with single or multiple junctions. In some embodiments, the photon absorbers comprise multiple layers with each formed of a different semiconductor. In one embodiment, the multiple layers are stacked on the top of each other in a tandem configuration. In some embodiments, the photovoltaic module comprises one or more photovoltaic cells.

In some embodiments, the electrolyte contains glycerol.

In some embodiments, the at least one electrochemical cell is configured to generate hydrogen from glycerol oxidation at a cell potential that is significantly smaller than that for water splitting.

Certain aspects of the invention also discloses an electrochemical device comprising at least one electrochemical cell comprising an anode electrode and a cathode electrode; and a source of electricity for providing a potential between the anode electrode and the cathode electrode for driving the at least one electrochemical cell to facilitate redox reactions therein.

In some embodiments, the anode electrode comprises a substrate and a metal-based electrocatalyst formed on the substrate. In some embodiments, the metal-based electrocatalyst comprises Au, Pt, Pd, or other noble metals and/or transition metals including Bi. In some embodiments, the metal-based electrocatalyst is formed on the substrate in a single layer structure, or a multilayered structure. In some embodiments, the substrate comprises a current collecting electrode conformally coated with the metal-based electrocatalyst. The current collecting electrode can be formed of any metal, carbon, conductive polymer, etc. In one embodiment, the substrate comprises Ni.

In some embodiments, at least one of the anode electrode and the cathode electrode is a photoelectrode configured to initiate photoelectrochemical oxidation reactions. In some embodiments, the photoelectrode comprises a photovoltage-generating component made from, but not limited to, inorganic (Si, GaAs, CdTe)-based, organic-based, metal-organic or covalent-organic framework-based, or perovskite (such as hybrid organic-inorganic lead or tin halide-based) photovoltaics currently used in commercial applications. In some embodiment, the cathode electrode is a copper bismuth oxide ($CuBi_2O_4$) photocathode. In other embodiments, the photoelectrode is based on group II-VI semiconductors (such as ZnSe, CdS, or relevant combinations), III-V semiconductors (GaP, GaN, InP, or others), group IV semiconductors (Ge-, Si-, or Sn-based materials), metal oxides (such as $Cu_2O$, $BiVO_4$, or other combinations of metals in an oxide semiconductor), metal chalcogenides (such as $MoS_2$ or $WSe_2$), metal nitrides ($Ta_3N_5$, TiN, or others), metal phosphides (such as iron phosphide, nickel phosphide, molybdenum phosphide, tungsten phosphide, or others), or related mixed-anion compounds (oxynitrides such as $CeTiO_2N$, oxysulfides such as bismuth oxysulfide, chalcogenophosphates such as $FePS_3$ or $NiPS_3$). It should be noted that other types of photocathodes or photoanodes can also be utilized to practice the invention.

In some embodiments, the source of electricity comprises one or more photovoltaic cells for converting energy of photons to electrical energy.

Certain aspects of the invention further discloses a photoelectrochemical device comprising at least one electrochemical cell comprising an anode electrode and a cathode electrode, wherein at least one of the anode electrode and the cathode electrode is a photoelectrode configured, when illuminated with light, to initiate photoelectrochemical oxidation reactions in the at least one electrochemical cell.

In some embodiments, the anode electrode comprises a substrate and a metal-based electrocatalyst formed on the substrate. In some embodiments, the metal-based electrocatalyst comprises Au, Pt, Pd, or other noble metals and/or transition metals including. In some embodiments, the metal-based electrocatalyst is formed on the substrate in a single layer structure, or a multilayered structure. In some embodiments, the substrate comprises a current collecting electrode conformally coated with the metal-based electrocatalyst. In one embodiment, the substrate comprises Ni.

In some embodiments, the photoelectrode comprises a photovoltage-generating component made from inorganic, organic, or mixed photovoltaics.

In some embodiments, the at least one electrochemical cell further comprises an anode compartment, a cathode compartment, and an anion exchange membrane separating the anode compartment and the cathode compartment, wherein each of the anode compartment and the cathode compartment contains a same electrolyte, or a different electrolyte.

In some embodiments, the electrolyte contains glycerol.

In some embodiments, the at least one electrochemical cell is configured to generate hydrogen from glycerol oxidation at a cell potential that is significantly smaller than that for water splitting.

Certain aspects of the invention also discloses a method for valorization of glycerol comprising: providing at least one photoelectrochemical cell comprising an electrolyte containing glycerol, an anode electrode and a cathode electrode, wherein at least one of the anode electrode and the cathode electrode is a photoelectrode; and illuminating the at least one photoelectrochemical cell with light so that the photoelectrode initiate photoelectrochemical oxidation reactions to promote catalytic oxidation reactions in the at least one electrochemical cell, thereby generating hydrogen from glycerol oxidation.

In some embodiments, the anode electrode comprises a metal-based electrocatalyst. In some embodiments, the metal-based electrocatalyst comprises Au, Pt, Pd, or other noble metals and/or transition metals including Bi.

In some embodiments, the photoelectrode comprises a photovoltage-generating component made from inorganic, organic, or mixed photovoltaics.

Certain aspects of the invention include a Si-glycerol electrolyzer system to generate $H_2$ under sunlight.

Certain aspects of the invention also include an "artificial leaf" from a small-bandgap semiconductor (e.g., $Cu_2O$) with a sufficient photovoltage to generate hydrogen at practical current densities.

Certain aspects of the invention include characterizing the oxidation products of glycerol oxidation. Current spectrometry indicates that the product is likely dihydroxyacetone, a more valuable commodity chemical than glycerol.

Certain aspects of the invention also include performing a technoeconomic analysis for what the target "stopping point" of glycerol oxidation should be, i.e., it is more economical to extract every possible $H_2$ molecule (taking glycerol to $CO_2$) or there are some valuable stopping points along the mechanism.

Certain aspects of the invention include demonstrating that failure on the electrocatalyst is due to a local dearth of glycerol to oxidize and therefore can improve longevity by low-power pumping of fresh glycerol solution to the electrocatalyst.

Certain aspects of the invention includes utilizing the electrochemical device for, but is not limited to, high-efficiency solar glycerol-to-hydrogen, valorization of glycerol (to dihydroxyacetone, lactic acid, etc.), commercially viable solar-to-fuels "artificial leaf", and steam reforming of glycerol to hydrogen, and solar hydrogen from a process of photovoltaic electricity generation feeding an electrolyzer.

Certain aspects of the invention provide beneficial advantages of lower cell potentials/voltages for converting glycerol into $H_2$ and value-added chemicals like dihydroxyacetone, lactic acid, and others, value-added for biodiesel waste stream, lower complexity for solar-to-hydrogen, especially for photoelectrochemical devices/artificial leaf, and scalable—low mass of noble metals for electrocatalyst layer on scalable electrode material.

According to the invention, the electrochemical device can increase the photo-potential generated with a photon absorption across a broader spectrum, achieving higher solar-to-hydrogen efficiencies.

These and other aspects of the present invention are further described below. Without intent to limit the scope of the invention, exemplary instruments, apparatus, methods and their related results according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Example 1

Characterizing Sustained Solar-to-Hydrogen Electrocatalysis at Low Cell Potentials Enabled by Crude Glycerol Oxidation Unassisted solar-driven water electrolysis as a sustainable source for $H_2$ is limited by the high overpotential necessary to drive the oxygen evolution reaction (OER). Crude glycerol is an extremely alkaline biproduct of biodiesel synthesis that can be valorized or refined to produce more desirable chemicals. Glycerol can also be directly oxidized on an anode, replacing water oxidation, to reduce the applied cell potential requirements of electrolytic $H_2$ production or $CO_2$ reduction. An advantage of oxidizing glycerol in its crude form is the opportunity to valorize it without initial refinement.

In this exemplary example, we report on the use of crude glycerol as a sacrificial fuel for unassisted, light-driven hydrogen generation. We describe an electrocatalyst based on a layered Au—Pt—Bi thin film that reduces the required applied potential for glycerol oxidation over previously reported bimetallic electrocatalysts, while improving the longevity of electrooxidation. As a result, an electrolysis cell based on this anode and a highly catalytically active Pt HER cathode is capable of generating hydrogen from glycerol oxidation at the target rates for high-efficiency STH PEC cells at a significantly smaller overall two-electrode cell potential (0.8 V) versus water splitting (>1.7 V). Increasing the true surface area of this anode by adding three-dimensional structure to the substrate results in even lower cell voltages required for the same geometric current density. We demonstrate that this overall cell design can produce hydrogen at significant rates from a single, monocrystalline Si solar cell ($V_{oc}$=630 mV) or GaAs solar cell ($V_{oc}$=960 mV) without added bias under less than one-sun illumination intensities. We also consider the fate of the glycerol electrooxidation products in the model crude electrolyte. Crude glycerol is more concentrated and more alkaline than is generally studied in research systems. The alkalinity can catalyze the spontaneous transformation of glycerol electrolysis products. An advantage of sacrificial crude glycerol is the opportunity of using it without any prior refining or purification. It is therefore important to decouple the direct electrolysis products from the subsequent spontaneous chemical reactions in the electrolyte to guide selective separations as a glycerol valorization strategy. We used spectrochemical and analytical techniques to improve our understanding of the compounds formed during crude glycerol oxidation. These results show that simpler integrated systems based on a single light absorber driving glycerol oxidation can achieve higher rates of hydrogen production than water splitting by eliminating the constraint of matching photocurrents in tandem devices. From a research perspective, decoupling the photovoltage generation from electrocatalysis by using commercially available solar cells prevents any ambiguity in the interpretation of the experiments. However, these results can be extended to the development of other PV- or PEC-based devices utilizing glycerol oxidation more generally.

Materials and Methods

Materials: Acetone (99.5%; EMD Millipore Corp) and water (high-performance liquid chromatography (HPLC) grade; VWR Analytical) were used as received. Sodium hydroxide (50% w/w; VWR Analytical) was diluted to 2.20 M with water. A solution of sulfuric acid (95%-98%; VWR Analytical) was diluted to 0.010 M with water. Nitric acid (69.0-70.0%; JT Baker) was diluted to 1.0 M with water. A 1.0 N stock solution of aqueous hydrochloric acid was used as received (VWR Chemicals). The crude glycerol model electrolyte was prepared by diluting glycerol (99.7%, Food Grade, Bluewater Chemgroup) to 20.0% (w/w) in a prepared 2.20 M NaOH solution for electrochemical characterization. The pH of this crude glycerol model solution was 13.75 as measured by a pH meter. Potassium tetrachloroplatinate (II) (98%, Sigma Aldrich) and sodium tetrachloroaurate (III) dihydrate (99%; Sigma Aldrich) solution were each prepared at 0.40 mM and 0.60 mM, respectively, by dissolving into the as-prepared sulfuric acid. Bismuth (III) nitrate pentahydrate (99.99%; Sigma Aldrich) was prepared at a concentration of 1 mM by dissolution into the 1.0 M nitric acid solution. Ni foil (99.9%; Goodfellow) was diced into 2.5 cm×2.5 cm square substrates. Ni foam (99.99%; MTI) was cut to desired size. Deuterium oxide (99.8%; Acros) and potassium hydroxide pellets (99.98%; Acros) were used to prepare 2.0 M KOH solution in $D_2O$ for proton nuclear magnetic resonance ($^1$H-NMR) spectroscopy experiments. Glycerol (99.97%; Acros) was used in solutions prepared for analysis by NMR to minimize water in the $D_2O$-based electrolyte. Dihydroxyacetone (100%, Sigma), glyceraldehyde (>90%, Sigma), glyceric acid (20% in water, TCI), lactic acid (85%, Sigma), acetic acid (99%, Sigma), formic acid (97%, BTC), and methylglyoxal (35-45% in water, BTC) were all prepared at the specified concentrations within the text for product analysis experiments.

Electrode fabrication: Ni foil electrodes were prepared for galvanic replacement (GR) by sanding with a sequence of sandpaper with increasingly finer grit (from 3000 to 1500 grit) to remove residual coatings on the as received foils. Once GR reaction(s) were complete, the foils were dried with $N_2$ and conductive Cu tape was attached to the backside of the foil. The foil was loaded into the bottom of a high-density polyethylene (HDPE) press cell for electrochemical characterization. The electrode area was defined by a viton O-ring (0.785 cm$^2$). Porous Ni foam materials were prepared as electrodes by mounting the foam to a Ni wire sealed through a 6 mm O.D. glass tubes with epoxy (Loctite EA 9460). The foam electrode with added electrocatalyst layer was placed into the working compartment of the cell rather than being pressed by an 0-ring. The above procedure was used for 1 cm$^2$ and 6.5 cm$^2$ foam electrode. For larger size foam electrode, no glass tube was used. Instead, epoxy was used to protect the Ni wire connection to the foam and was kept out of contact with the solution.

Electrocatalyst synthesis on Ni substrates: Electrodes for the oxidation of glycerol were prepared by galvanic replacement (GR) reactions on Ni substrates using 0.6 mM Au GR solution and 0.4 mM Pt GR solution. These concentrations were chosen for the notable performance of the combination towards glycerol electrooxidation in previous work. The Ni substrates were sequentially rinsed with acetone to remove organic contaminants, submerged in 1.0 N HCl for 10 min to remove the native oxide, and then rinsed with water. The noble metal layers were deposited by submerging the foil substrate in the Au GR solution for 5 min, rinsing with water, and then submerging in the Pt GR solution for 5 min. Smaller Ni foam electrodes ($A_{geo}$=1 cm$^2$ or 6.5 cm$^2$) were prepared by the same method. Large foam electrodes were exposed to the Au GR solution for 10 min, rinsed, and then dipped in Pt GR solution for 10 min. Monometallic Au or Pt electrodes were fabricated by submerging the substrate in the corresponding GR solution for 5 minutes. A 1 mM $Bi(NO_3)_3$ electrodeposition solution was prepared in 1.0 M $HNO_3$. Bi was electrodeposited onto substrates as noted in the text. The electrodeposition was driven by chronopotentiometry with a potentiostat (Bio-Logic SP-240) for 5 sec at a geometric current density of −15 mA cm$^{-2}$.

Electrocatalyst characterization: Scanning electron microscopy (SEM) images of Ni substrates were taken with a FEI Nova Nanolab SEM equipped with energy-dispersive X-ray (EDX) spectrometer (Bruker XFlash 5010). X-ray photoelectron spectroscopy (XPS) measurements were performed on a Phi Versaprobe instrument with an Al Kα source (1486.6 eV) with a spot size of 100 μm×100 μm. All XPS binding energies were calibrated to measurements of the adventitious carbon is XPS peak for each electrode (284.8 eV).

Glycerol oxidation experiments were performed in a two-compartment electrochemical press cell made from HDPE. Ni foil experiments had an active working area of 0.785 cm$^2$ as defined by an O-ring in a press-cell configuration. Current densities measured on the Ni foam electrodes were normalized to the geometric area of the electrode. The working electrode compartment contained the electrocatalyst-coated Ni substrate and the reference electrode. The counterelectrode compartment contained a graphite counterelectrode (99.997%; Goodfellow). The two compartments were separated by a Zirfon membrane (UTP 500; 500 μm thickness; Zirfon Perl) and sealed with a pair of Viton O-rings to prevent $H_2$ or glycerol oxidation product crossover from affecting the electrochemical characterization. Cyclic voltammetry (CV) measurements were performed at a scan rate of 50 mV s$^{-1}$ with the 20% (w/w) and 2 M NaOH as electrolyte for these experiments. All working electrode potentials were measured versus an Hg/HgO reference electrode (1.0 M NaOH; CH Instruments), then converted to the real hydrogen evolution potential via the Nernst equation:

$$E(vs\ RHE) = E(vs\ \mathrm{Hg/HgO}) + E^\circ + 0.0592\ \mathrm{V} \times \mathrm{pH} \quad (1)$$

$$E^\circ = 0.098\ \mathrm{V}\ \text{for Hg/HgO (1M NaOH)} \quad (2)$$

A 20% (w/w) (roughly 2 M) solution of glycerol in 2 M KOH was chosen as the model for crude glycerol in this work to emphasize the high concentrations of each component. This is comparable to prior analyses of the composition of the crude formed as a biproduct of biodiesel production, though the true composition of crude is process dependent. The other components found in crude glycerol (methanol, ash, etc.) are not considered in this work to isolate the electrooxidation activity for glycerol.

Chemical product analysis: HER faradaic efficiency was measured by gas chromatography (GC), where the headspace gases were sampled at 15-min intervals. The headspace sample was drawn using a gastight syringe (100 μl; A-2, Vici Precision Sampling) and injected into the GC (SRI 8610C equipped with a 2 m HayeSepD column). Ultra-high purity argon (99.999%, Airgas) was used as the carrier gas. The quantity of hydrogen produced was measured using a thermal conductivity detector (TCD). The measured quantities of $H_2$ were compared to the amount of hydrogen predicted from the chronoamperometry to assess the HER faradaic efficiency.

Glycerol oxidation products and relevant standards were analyzed using NMR. $^1$H-NMR (400 MHz, Bruker) spectra were measured using $D_2O$ as the solvent, rather than $H_2O$. Standards were prepared at 100 mM concentrations in an electrolyte containing 2 M KOH in $D_2O$. Of the standard, 700 μL was placed into an NMR tube (WG-1000-7; Wilmad). The NMR was automatically tuned and shimmed before each sample was pulsed. Bruker Topspin was used to control the NMR and analyze the resultant spectra.

Solar cell I-V characteristics: Si solar cell I-V curves were obtained using a large white chip-on-board (COB) LED array (Solla) as a light source. The solar cell was connected to the potentiostat, and a current-voltage (I-V) measurement was recorded from −0.1 V to 0.65 V. GaAs solar cell I-V curves were obtained in an identical manner, though a white COB LED (Boruit) was used as the light source. An I-V measurement was recorded from −0.1 V to 1.0 V. Both I-V measurements were performed at a scan rate of 50 mV $s^{-1}$. To ensure the applicability of the results to solar energy conversion, the solar cell-driven experiments were performed at light intensities less than one-sun illumination. This is indicated by the fact that the maximum power point of the solar cells used here was significantly lower than the benchmarked operating point specified by the manufacturer for one-sun illumination.

In situ electrode restoration experiments: Durability experiments (with and without added $Bi(NO_3)_3$) were performed in situ on 1 $cm^2$ (geometric area) AuPtBi—Ni foam electrodes. The electrode was exposed to electrolyte on both sides. The electrolyte used in the working and counter compartments was the same model crude glycerol solution used for other experiments. Working and counter compartments were separated by a Zirfon membrane. $Bi(NO_3)_3$ was added to a concentration of 1 mM in the anode compartment for experiments where a cathodic step was used for in situ Bi re-deposition. In a three-electrode experiment (1 $cm^2$ AuPtBi working electrode, 1 $cm^2$ Pt—Ni foam counter electrode, Hg/HgO reference electrode), glycerol electrooxidation was performed at 10 mA $cm^{-2}$ for 12 hours or until the applied potential reached a limiting value, $E_{limit}$, of 0.609 V vs RHE (−0.300 V vs Hg/HgO). A cathodic step was added to the potentiostat control program and would execute after the elapsed time or $E_{limit}$ was achieved. Experiments without the addition of $Bi(NO_3)_3$ were run at a −0.1 mA $cm^{-2}$ cathodic current density for 30 s. Experiments with 1 mM $Bi(NO_3)_3$ added to the glycerol solution were run −1 mA $cm^{-2}$ for 30 s except for the first cathodic cycle which was −0.1 mA $cm^{-2}$ to match the first cycle in the Bi-free solution. Lower current densities were used in the absence of $Bi(NO_3)_3$ to yield potentials just negative of the Au and Pt reactivation peaks. The change to more negative current densities in the presence of $Bi(NO_3)_3$ was to promote the electrodeposition of Bi onto electrode surface.

Results and Discussion

Characterization of the AuPtBi electrocatalyst for glycerol oxidation: Characteristic cyclic voltammetry of each monometallic electrocatalyst deposited as a conformal layer on the Ni foil, is shown in panel (a) of FIG. 4. The standard potential for glycerol oxidation to $CO_2$ can be calculated using thermodynamic data (E°=−0.01 V vs SHE, the standard hydrogen evolution potential). The true thermodynamic potential and any measurement of overpotentials requires more detailed knowledge of the actual reactions being carried out on the electrode surface. We therefore used the onset potential for anodic current to compare the activities of different electrocatalysts for glycerol oxidation. Pt had the lowest onset potential for glycerol oxidation in the quiescent model crude glycerol solution (E=0.6 V vs. RHE), with a peak current density of 11 mA $cm^{-2}$ before the surface oxidized and electrooxidation of glycerol ended. The onset potential for glycerol oxidation on Au was higher (E=0.8 V vs. RHE) with no observed cessation of glycerol oxidation in the potential range measured. Au oxidizes to form hydroxides at 1.4 V vs. RHE at pH 14, where electrocatalytic glycerol oxidation could compete with water oxidation. The complexities of electrocatalysis at positive potentials on polycrystalline Au in strong alkaline solutions have been discussed at length elsewhere. Negligible oxidation current was observed on the Bi electrode in the potential range corresponding to glycerol oxidation (0.4-1.0 V vs RHE). A small amount of Bi was added to Pt and Au electrodes via electrodeposition of Bi to compare the electrocatalytic behavior of AuBi and PtBi bimetallics, as shown in panel (b) of FIG. 4. The addition of Bi to Pt (PtBi) slightly reduced the onset potential for glycerol oxidation (E=0.5 V vs. RHE) and increased the peak oxidation current density (36 mA $cm^{-2}$) before surface oxidation, compared to the Pt-only electrode. The addition of Bi to the Au electrode (AuBi) showed no significant difference in activity compared to the Au-only electrode. An AuPt electrode prepared by sequential GR deposition of Au and Pt on Ni (panel (c) of FIG. 4) showed similar cyclic voltammetry to the PtBi electrode, with the addition of a second oxidation peak at E=1.5 V vs. RHE due to the oxidation of the small amount of Au accessible to the electrolyte. The addition of Bi via electrodeposition to an identically prepared AuPt electrode resulted in an AuPtBi electrocatalyst that demonstrated the highest peak current for glycerol oxidation on Pt-based electrode (60 mA $cm^{-2}$), indicating improved glycerol activity for the trimetallic electrocatalyst. Oxidized Ni interfaces, specifically $Ni(OH)_2$/NiOOH, can also act as glycerol oxidation electrocatalysts. However, as noted in previous studies the Ni substrate does not participate in the glycerol oxidation reaction unless sufficiently positive potentials are applied to form the glycerol-active, oxidized Ni species (E>1.2 V vs. RHE).

Figure 4:
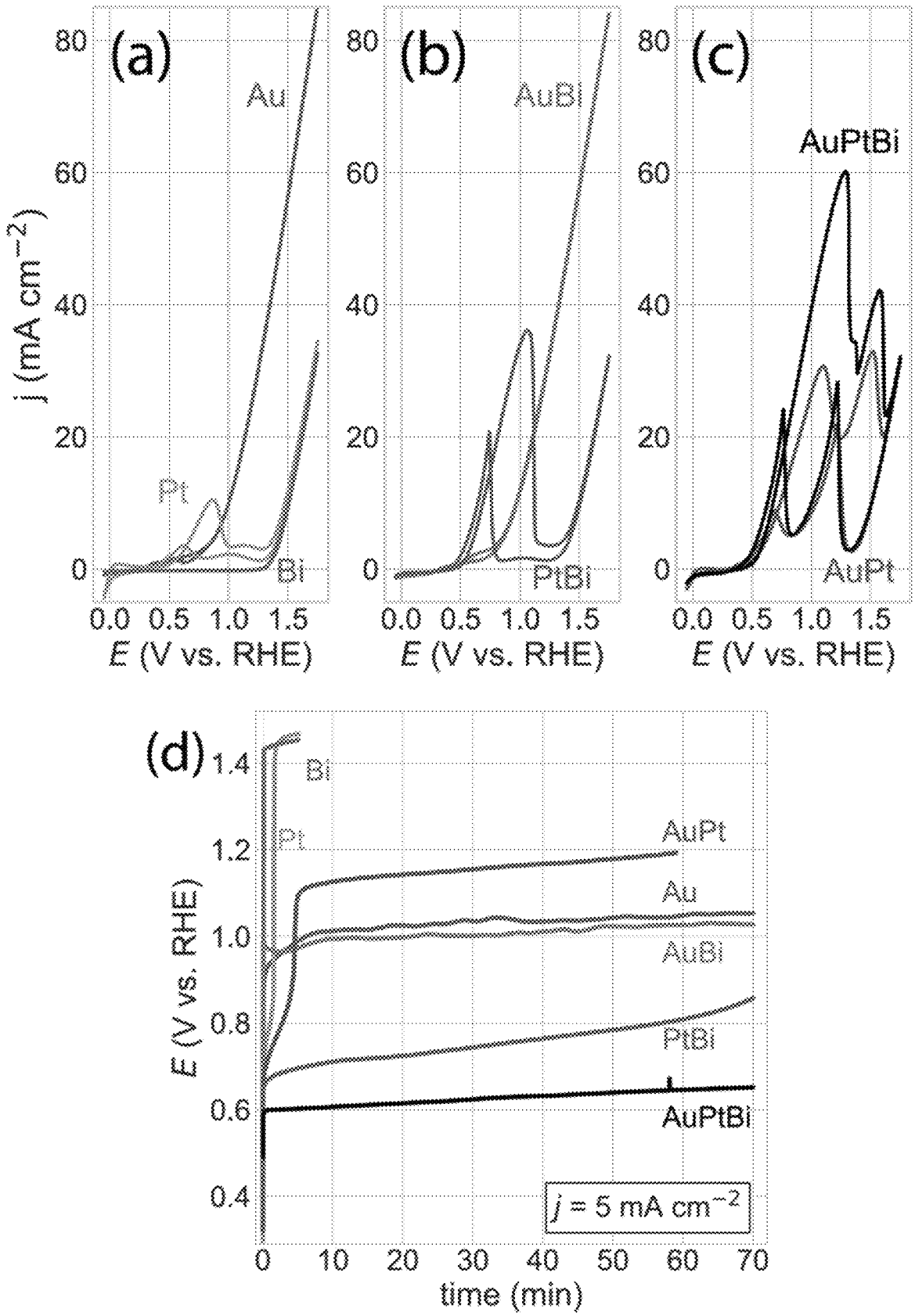
FIG. 4 shows various characterizations of an electrochemical device according to embodiments of the invention. Panel (a): Cyclic voltammograms (CV) of planar, monometallic Au, Pt, and Bi electrocatalysts on Ni foil electrodes. Panel (b): CVs of planar, layered AuBi and PtBi electrocatalysts on Ni foil electrodes. Panel (c): CVs of planar AuPt and AuPtBi electrocatalysts on Ni foil electrodes. Panel (d): Chronopotentiometry measurements of glycerol electrooxidation (5 mA $cm^{-2}$) on the electrode constructions from panels (a), (b), and (c). The vertical axis indicates the potential applied (vs. RHE) to achieve the desired current density. Low E values indicate glycerol oxidation on the electrocatalysts, while an abrupt shift to higher potentials indicates that the electrocatalyst surface has fully oxidized. Electrolyte used for these experiments was 20% (w/w) glycerol in aqueous 2.0 M NaOH (pH=13.75).

The longevity of glycerol electrooxidation as a function of electrode composition was measured by three-electrode chronopotentiometry at a fixed anodic current density, j=5 mA $cm^{-2}$, as shown in panel (d) of FIG. 4. Pt and Bi electrodes shifted to positive potentials (E>1.42 V vs. RHE) almost immediately. Au and AuBi electrodes steadily carried out glycerol oxidation at E=1.00-1.05 V vs. RHE for the duration of the experiment. AuPt performed glycerol oxidation at low applied potentials (E<0.8 V vs. RHE), but the potential increased to E=1.1-1.2 V vs. RHE within 5 minutes. This steady-state applied potential is still not positive enough to drive water oxidation (E°=1.23 V vs. RHE), which suggests that the current comes from Au performing glycerol electrooxidation after the oxidative inactivation of surface Pt sites. The addition of Bi resulted in protracted glycerol electrooxidation at the lower positive potentials noted for Pt (E=0.6 V vs RHE). PtBi began at E~0.7 V vs. RHE, and steadily increased to 0.84 V vs. RHE by the experiment's end. AuPtBi operated at E=0.6 V vs. RHE with a slight increase to 0.63 V vs. RHE by the completion of the experiment. The combination of Au, Pt, and Bi provided both improved steady-state j-E behavior and prolonged electrooxidation activity compared to the other combinations of the same components.

Figure 5:
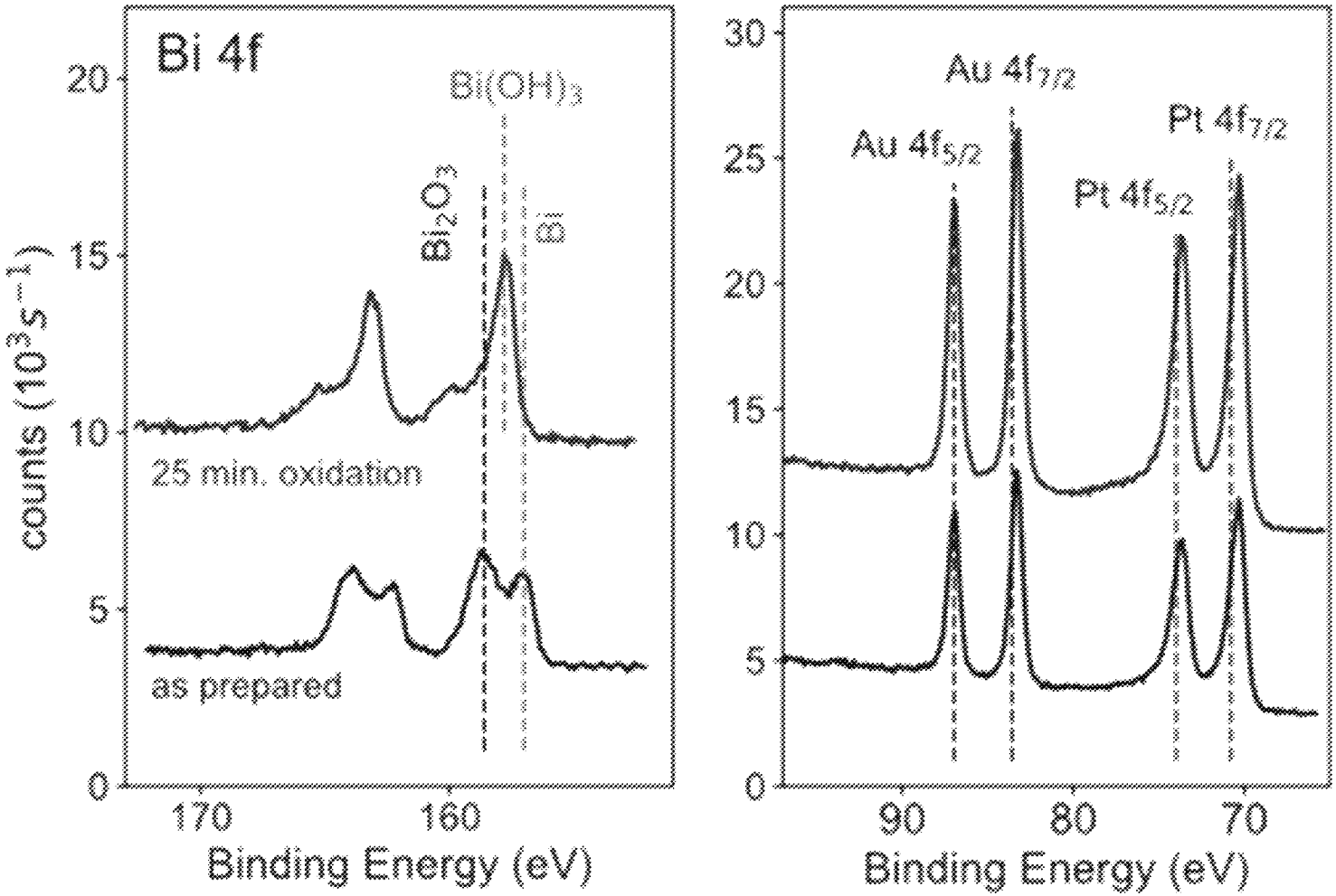
FIG. 5 shows XPS characterization of the Bi 4f (left) and the 4f XPS features for Au and Pt (right) for Au—Pt—Bi electrocatalysts described in this work. The black XPS spectra were measured on the electrocatalyst as prepared. The blue XPS spectra were measured on an identically prepared electrocatalyst after 25 min of glycerol oxidation at 2.5 mA $cm^{-2}$ in 20% (w/w) glycerol/2.0 M NaOH solution. The post-electrolysis (blue) spectra are shifted artificially along the y-axis to improve comparability. For these electrodes, the Bi electrodeposition was performed for 1 s via the procedure described in the text. No peaks from the Ni substrate were observed in measurements of the Ni 2p spectra on either sample. Standard Au and Pt 4f energies are shown with dashed lines.

X-ray photoelectron spectroscopy (XPS) measurements of the as-prepared AuPtBi electrocatalysts and of an electrode directly following a 25 min galvanostatic (j=2.5 mA $cm^{-2}$) crude glycerol oxidation experiment is shown in FIG. 5. The Bi 4f XPS spectra indicates that both Bi metal and a surface oxide are present on the as-prepared electrode surface. After the electrooxidation experiment the surface Bi had transformed into $Bi(OH)_3$, consistent with the proposed functional role of Bi in the glycerol oxidation mechanism. The intensity of the Au 4f and Pt 4f XPS features increased after electrooxidation compared to the as-prepared electrocatalyst, indicating some increased surface presence due to Bi dissolution or other interfacial transformation. The chemical shifts observed for the Au 4f (0.3 eV) and the Pt 4f (0.8 eV) features to lower binding energies versus the monometallic references remained steady before and after the electrooxidation and are consistent with previous measurements of AuPt electrodes.

Figure 6:
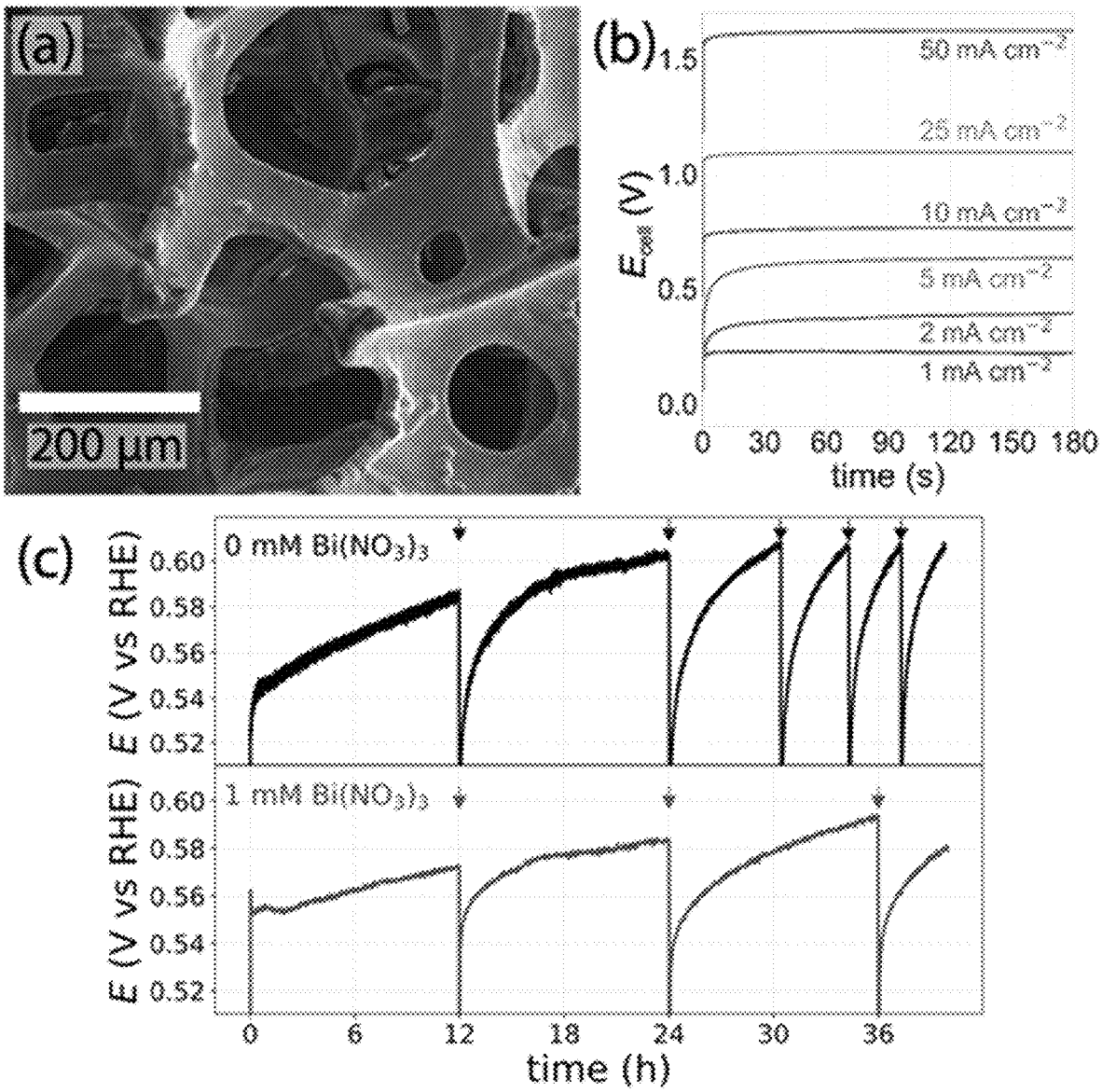
FIG. 6 shows various characterizations of an electrochemical device according to embodiments of the invention. Panel (a): Scanning electron micrograph (SEM) of the AuPtBi electrocatalyst deposited on a commercial Ni foam. The layered thin film electrocatalyst is conformally deposited on the Ni foam surface. Panel (b): The cell potential, $E_{cell}$, from chronopotentiometry measurements of glycerol oxidation and hydrogen evolution on a Ni foam-based AuPtBi anode and a Ni foam-based Pt cathode, respectively. The areal current density is defined with respect to the geometric surface area of the highly porous Ni foam. Panel (c): The applied bias (E) for AuPtBi glycerol electrooxidation at constant current of 10 mA $cm^{-2}$ in model crude glycerol solution as prepared (black) or with 1 mM of $Bi(NO_3)_3$ added to the solution (red). A cathodic reverse step (−1 mA $cm^{-2}$ for 30 sec; noted by an arrow) was added to the potentiostat control sequence to run when either 12 hr of glycerol electrooxidation had passed or the applied potential had increased to a limiting value (−0.3 V vs. Hg/HgO=0.609 V vs. RHE). This step was meant to help the electrode recover by reducing the AuPt portion of the catalyst or by re-depositing Bi that may have been lost from the electrode surface during glycerol electrooxidation. The electrode with Bi in solution did not reach the potential limit during the 40 hr experiment.

The surface specificity of galvanic replacement and electrodeposition allowed for the synthesis of AuPtBi layers onto high surface area Ni foam electrodes, as shown in panel (a) of FIG. 6. In these experiments, both sides of the electrode were exposed to the bulk solution, a Ni foam-based, AuPtBi anode (prepared with an area of 1.0 $cm^2$) was paired with a GR-synthesized Pt-on-Ni foam cathode (area=12 $cm^2$) in a two-compartment electrochemical cell. The anode and cathode compartments were separated by a Zirfon anion exchange membrane. Chronopotentiometry measurements of the cell potential, $E_{cell}$, as a function of geometric current density in the model crude glycerol electrolyte is shown in panel (b) of FIG. 6. The combination of the low applied potential needed to oxidize glycerol on the AuPtBi surface and the multiplicative effect of the surface area of the foam resulted in low overall cell potentials for the simultaneous glycerol oxidation and hydrogen evolution reactions. At 10 mA $cm^{-2}$, the steady state cell potential ($E_{cell}$=0.75 V) was significantly lower than the practical 1.7 V minimum required for the full water splitting reaction. The steady state cell potential $E_{cell}$=1.6 V at 50 mA $cm^{-2}$ was still smaller than the practical 10 mA $cm^{-2}$ target for water splitting electrolysis.

In situ electrochemical restoration of electrocatalysts: We characterized the stability of the foam AuPtBi anode by measuring the applied potential, E, required to maintain a constant 10 mA $cm^{-2}$ geometric current density. Loss of the active metal species to dissolution or oxidation can lead to an observed increase in E. Panel (c) of FIG. 6 shows a foam based AuPtBi anode performing glycerol electrooxidation in the model crude solution (black). The electrode polarization was reversed either after 12 hr or if the E rose to a preset upper limit of 0.609 V vs. RHE. Over the course of 12 hr, the electrode potential increased by 50-60 mV in the quiescent electrolyte. After the first cathodic reverse step, the initial low potential was restored, though rapidly increased within a few hours. After the second cathodic reverse step, the electrode began to hit the potential limit rather than run for a full 12 hr. For an electrode running in the same solution with 1 mM added $Bi(NO_3)_3$ (red), the same experiments showed <30 mV increase over 12 hr for the first two cycles and did not reach the potential limit in the 40 hr period of the experiment. This suggests that a small amount of Bi added to the solution replenishes the surface with Bi and prolongs the operation at low applied bias. The 12 hr cycle is significant in that it represents the day-to-day operation of a solar-driven integrated system. The addition of a short cathodic reversal to electrocatalysis during a rest period acts to restore the electrocatalytic activity of the anode and maintain performance for an extended duration. The results here demonstrate the extended or perhaps even indefinite operation of this electrocatalyst system for glycerol electrooxidation. The AuPtBi electrocatalyst system is resistant to deleterious surface oxidation at relevant current densities for pairing with fuel-forming cathodic half-reactions such as $CO_2$ reduction or HER.

Figure 7:
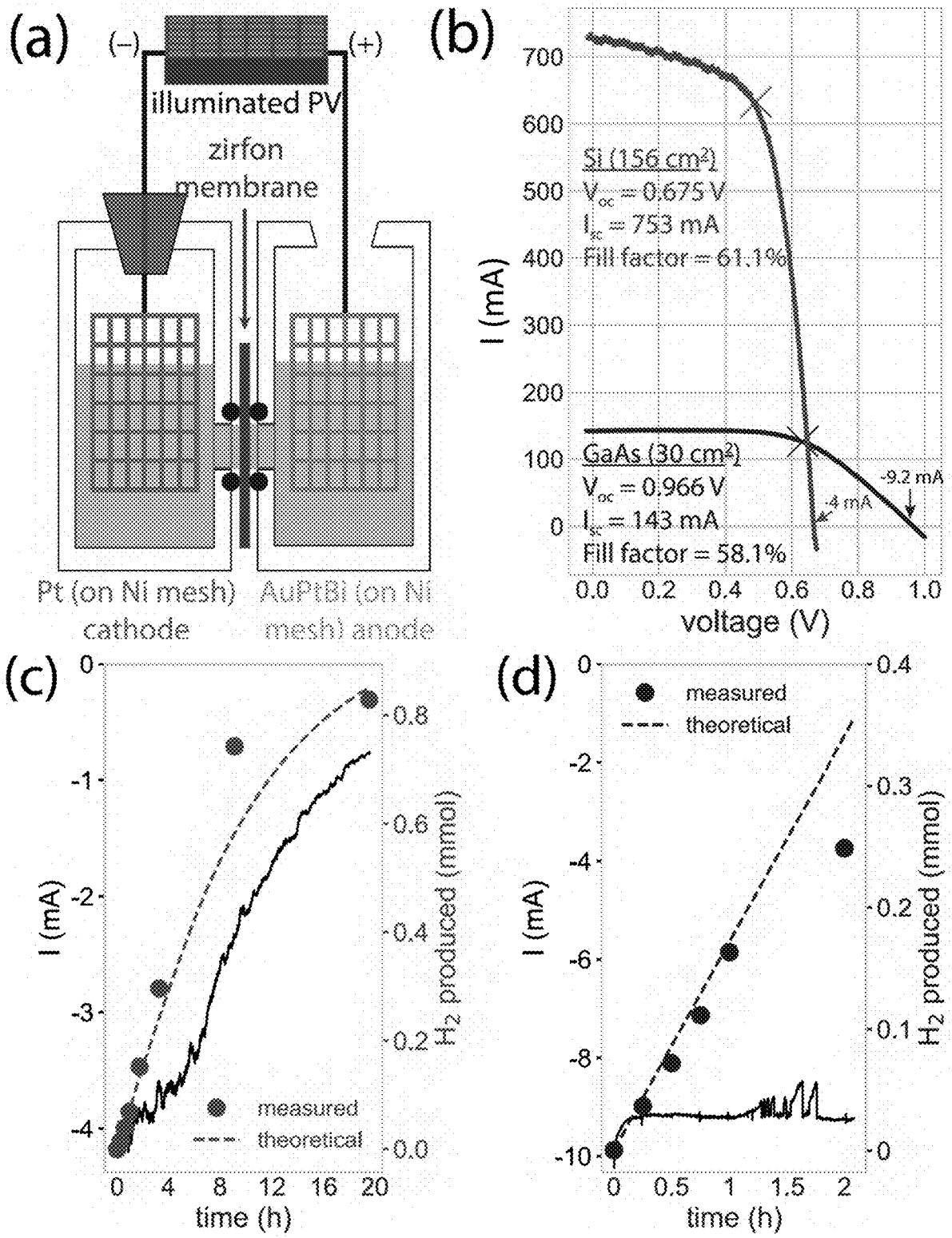
FIG. 7 shows various characterizations of an electrochemical device according to embodiments of the invention. Panel (a): A schematic of the two-compartment cell used for these experiments. The anode and cathode compartments contained the same electrolyte and were separated by a Zirfon anion exchange membrane. The solar cell was illuminated by a conventional white LED. Panel (b): The I-V characteristic curves under a white LED lamp for the Si (SunPower E60 monocrystalline Si; maximum power=0.31 W) and GaAs (TecStar GaAs on Ge, single junction; maximum power=0.080 W) photovoltaic cells used to drive glycerol-$H_2$ electrolysis. The maximum power point on each I-V curve is noted by an 'X', and the initial electrolysis operating points are noted by an arrow for each solar cell. This maximum power point is significantly lower than the manufacturer specifications for each solar cell (3.6 W for the Si, 1 W for the GaAs) due to the lower-than-one sun illumination conditions. Panels (c)-(d): The photocurrent and gas-chromatography determined yields of $H_2$ from glycerol-$H_2$ electrolysis driven by the Si (panel (c)) and by the GaAs (panel (d)) photovoltaics characterized in panel (b).
Figure 12:
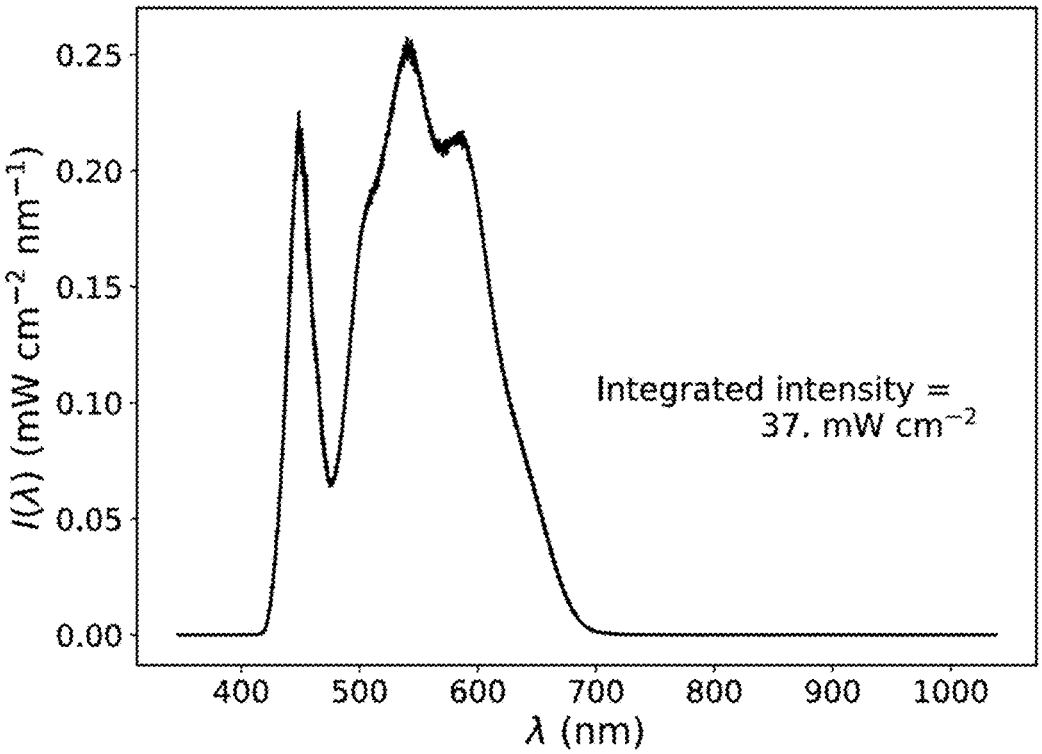
FIG. 12 shows an absolute spectrum of the Solla COB-LED used for the Si PV electrolysis experiments (FIG. 7). The relative spectrum was measured using a UV-Vis spectrometer (USB4000, Ocean Optics). The absolute power was calculated from a measurement of the photocurrent from a calibrated photodiode (FDS1010, Thorlabs) using the integrated product of the relative spectrum of the lamp and the responsivity curve (R(λ), provided by the manufacturer in units of A W-1).
Figure 13:
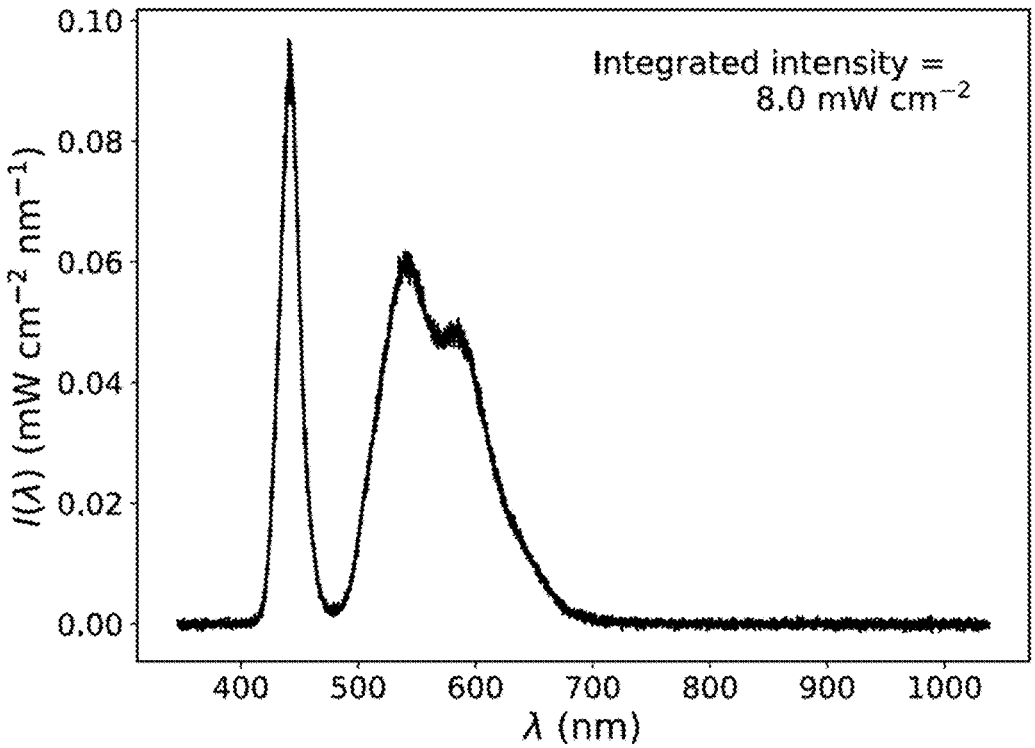
FIG. 13 shows an absolute spectrum of the Boruit COB-LED used for the GaAs PV electrolysis experiments (FIG. 7), calculated from spectroscopic and photodiode measurements in the same manner as in FIG. 12.

Unassisted, PV-driven glycerol-to-$H_2$ electrolysis: The low cell potentials allow for a solar-to-hydrogen photoelectrolysis cell to be driven by a single-junction solar cell in the quiescent model crude solution. We used a monocrystalline Si (SunPower E60) and a GaAs (TecStar) single junction photovoltaics to demonstrate this photoelectrolysis approach, as schematically shown in panel (a) of FIG. 7. This demonstration was a traditional photovoltaic+electrolyzer configuration, which was chosen as a matter of experimental convenience to decouple the photovoltaic power generation from the electrocatalysis. Additionally, the use of white light LEDs to drive the PV was also convenient for experiment. The I-V characteristics of each cell were measured under a white LED lamp, as shown in panel (b) FIG. 7, used for each electrolysis experiment. The spectra for the LED used for the Si PV and the GaAs PV are provided in FIG. 12 and FIG. 13, respectively. The intensity of the LED source generated lower open circuit voltages and short circuit currents than specified for each cell under one-sun illumination as power generated by the LED lamp is significantly lower than the manufacturers' specifications for one-sun illumination. Therefore, the performance here is lower than one would expect from direct solar illumination. Additionally, the lessons taken from these demonstrations can be applied more generally. For example, they could be used for the design of a PEC-based integrated system, rather than a PV-driven electrolyzer.

The Pt-coated Ni foam cathode and the AuPtBi-coated Ni foam anode (each with geometric area=37 $cm^2$) were prepared directly prior to each experiment. The cathode compartment was made gas-tight with a septum. Prior to each experiment, the catholyte was purged with $N_2$ for ~30 min to remove residual 02 as a possible electrochemical reduction target. The results of a 20-hour photoelectrolysis experiment driven by the Si solar cell is show in panel (c) of FIG. 7. The cathodic current was steady (−4 mA, corresponding to an operating cell voltage of roughly 0.66 V) for the first four hours, then decreased monotonically over the course of the rest of the experiment. The significant drop in electrolysis current after four hours can be explained by the observed increase in the cell potential corresponding to degradation of the electrocatalyst, as shown in panel (c) of FIG. 6. The current drops significantly for even slight increases in the load impedance near this point in the I-V characteristic for the Si PV, as shown in panel (b) of FIG. 7. Gas chromatography (GC) measurements of $H_2$ production ("measured") were within experimental error (roughly 10%) of the yield predicted by the cathodic charge passed ("theoretical"). The GaAs photovoltaic used a Ni foam-based Pt cathode and AuPtBi anode (each with geometric area=6.5 $cm^2$) to generate a steady electrolytic current of −9.2 mA (corresponding to an operating cell voltage of roughly 0.92 V) for more than 120 minutes, as shown in panel (d) of FIG. 7. The GC-measured $H_2$ production matches the calculated yield for the first 60 minutes, after which the increasing gas pressure in the cathode compartment generated a leak at the Zirfon membrane. Both PV-powered electrolysis cells operated at low currents and high cell voltages compared to the maximum power point identified from the characteristic I-V measurements of each. In addition to increasing the insolation, the performance could be improved by reducing the solution resistance, contact resistances for the integration of the PV, or adding stirring or flow to agitate the diffusion layer near the anode and cathode. Regardless, the results of the unoptimized, PV-electrolysis experiments described here suggest that unassisted, glycerol-based, solar-to-hydrogen system designs can achieve practical HER current densities at cell potentials that are otherwise incapable of driving overall water splitting.

Characterizing the products of crude glycerol electrooxidation: Glycerol is acting as a fuel in these reactions, so it is important to consider the glycerol oxidation products at these low practical cell potentials. From a technoeconomic perspective, one must consider the number of potential electrons that can be extracted from each glycerol molecule. The oxidation half-reaction for converting glycerol to carbon dioxide yields 14 electrons:

It is also important to understand the opportunities of glycerol valorization in the analyte or identify the generation of adverse or toxic products that would negate any "green" benefits of the generated hydrogen. Additionally, this is the first report to our knowledge of a trimetallic crude glycerol oxidation electrocatalyst.

Glycerol electrooxidation has been shown to produce glyceraldehyde at electrode potentials greater than 0.6 V vs. RHE and glyceric acid at potentials greater than 1 V vs. RHE in 0.1M NaOH on polycrystalline Pt. Under similar conditions, polycrystalline Au produces glyceric acid and formic acid, though requiring more positive potentials (>0.8 V vs. RHE) than the initiation of glycerol oxidation on Pt. Glycerate was the product at 0.6 V vs. RHE on Pt after the addition of $Bi^{3+}$ ions to the 0.1 M NaOH electrolyte, though glycolate and formate were also observed at higher potentials. Dihydroxyacetone was also observed as a product on Bi-modified Pt electrodes in acidic solutions. Additionally, the electrolytic products obtained from the oxidation of glycerol in the model crude solution are susceptible to spontaneous, base-catalyzed chemical reactions resulting in a range of non-faradaic products. At high pH, glyceraldehyde and dihydroxyacetone can undergo an irreversible dehydration reaction to form methylglyoxal. In turn, methylglyoxal spontaneously decomposes into smaller organic compounds such as lactate, formate, glycerate, and acetate. The spontaneous decomposition products formed by methylglyoxal in solution depend on the pH of the solution. There is significant ambiguity in the identification of the products of glycerol electrooxidation, particularly in the extreme conditions representative of crude glycerol. Implementing a process or integrated system that will oxidize crude glycerol sustainably requires a thorough understanding of the ultimate products involved and the implementation of chemical strategies to isolate the desired products in addition to hydrogen evolution on the cathode.

We first considered the fate of dihydroxyacetone (DHA) and glyceraldehyde (GALD), the direct, two-electron products of glycerol oxidation, in the same 2 M KOH electrolyte as the model crude glycerol solution. The model crude glycerol solution was relatively stable, remaining clear and colorless for months. Given this relative stability of glycerol in the 2 M KOH, we considered how the time-dependent products in the solution can indicate what the electrolytic products of glycerol oxidation are. We prepared solutions of 10 mM DHA and of 10 mM GALD in 2 M KOH and monitored the kinetics of the spontaneous transformation using UV-Vis spectroscopy. We observed a significant color change in both solutions over time, transforming from a colorless solution to an amber solution. The time evolution of the UV-Vis spectra for DHA and GALD (panels (a)-(b) of FIG. 8) showed that the kinetics of the reactions were different (slower in the GALD solution) over several hours. The pronounced and relatively long-lived peak at 400 nm in the DHA solution is potentially useful as a spectrochemical indicator of the presence of DHA in the solution.

Figure 8:
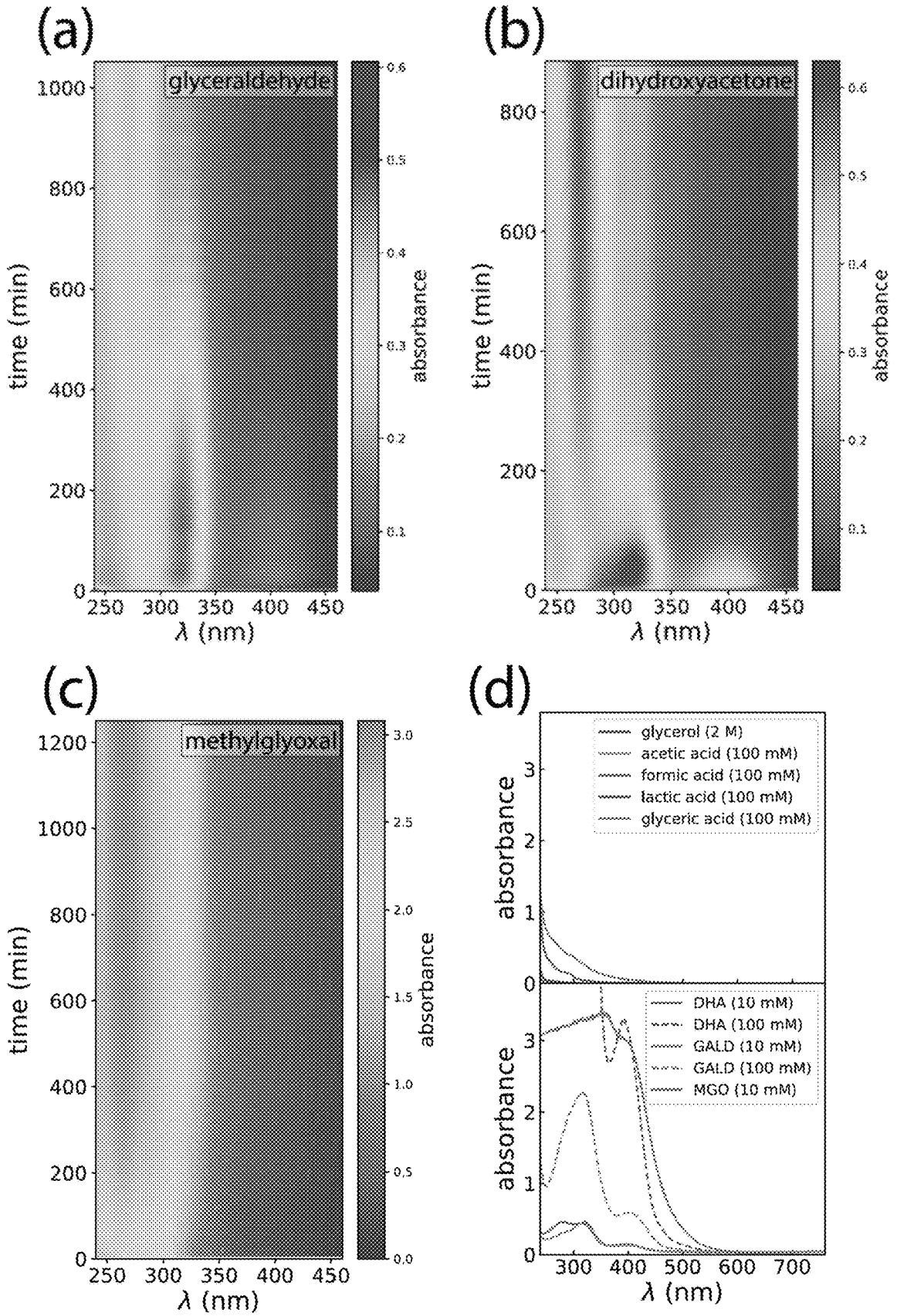
FIG. 8 shows various characterizations of an electrochemical device according to embodiments of the invention. Spectrochemical evolution of 10 mM (panel (a)) glyceraldehyde, (panel (b)) dihydroxyacetone, and (panel (c)) methylglyoxal added to 2 M KOH. Panel (d): UV-vis spectra for solutions (top) for dihydroxyacetone (DHA), glyceraldehyde (GALD), and methylglyoxal (MGO) and (bottom) for glycerol, acetic acid, formic acid, lactic acid, and glyceric acid. All solutions are prepared with 2 M KOH in the electrolyte. DHA and GALD are shown for both 100 mM and 10 mM solutions to facilitate comparisons between the spectrochemical data in panels (a), (b), and (c) and the spectra for the other compounds in panel (d). Each solution was aged for two hours after preparation before the corresponding spectrum was measured. These spectra show that the significant color change in the DHA, GALD, or MGO solutions are not directly related to the presence of the spontaneous products generated by reactions with the alkaline solution.

A 100 mM solution of MGO in 2 M KOH almost immediately generated the same amber color, as shown in panel (c) of FIG. 8. The relatively rapid formation of spectrochemical features in the MGO solution (260 nm and 295 nm) resemble the long-time (>15 h) spectra for DHA and GALD. The spontaneous formation of the noted decomposition products has been observed upon the addition of MGO to alkaline solutions. However, no visible color changes or significant differences were observed in intentionally prepared solutions of these compounds (100 mM concentrations of lactic acid, formic acid, glyceric acid, or acetic acid in a 2 M KOH aqueous solution, panel (d) of FIG. 8) as indicated by the UV-vis spectra for each. The solutions remained colorless for several months in the solution. The color change in solutions with DHA, GALD, or MGO therefore indicates some other product formation that is more complex than the base-catalyzed formation of smaller molecular compounds. For example, dimerization, polymerization, and esterification of the products of glycerol oxidation have been observed in basic and acidic solutions. Further work is necessary to identify these complex products in the model crude glycerol solution.

Figure 9:
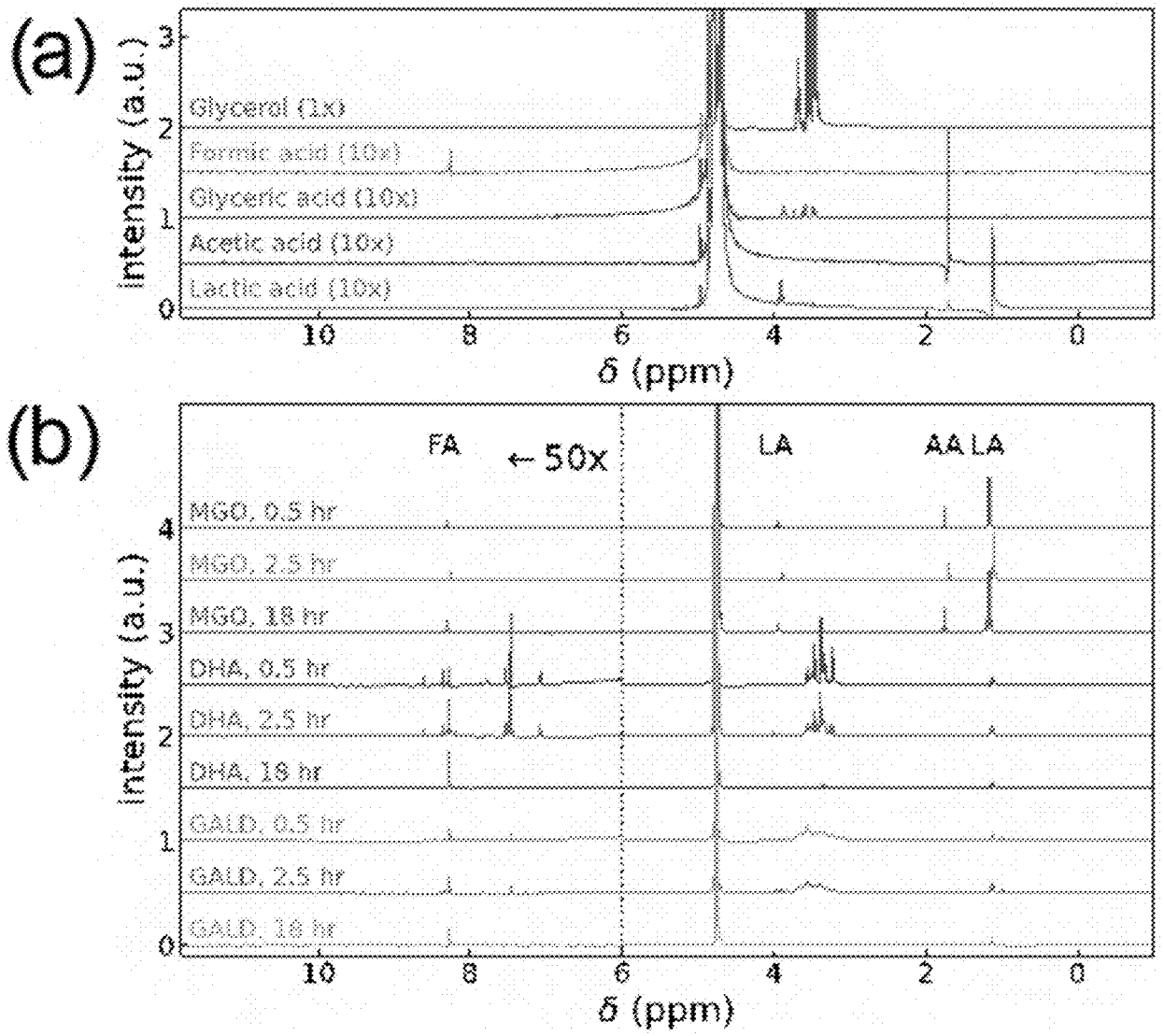
FIG. 9 shows various characterizations of an electrochemical device according to embodiments of the invention. Panel (a): $^1H$ NMR spectra for standards of notable compounds (glycerol, formic acid (FA), glyceric acid (GLA), acetic acid (AA), and lactic acid (LA)) in $D_2O$ with a base concentration of 2 M KOH. Each solution has 100 mM of the standard compound except for glycerol (2 M). Each spectrum is scaled by the noted factor to highlight the characteristic features for each. Panel (b): $^1H$ NMR spectra of the evolution of 100 mM solutions of methylglyoxal (MGO), dihydroxyacetone (DHA), and glyceraldehyde (GALD) in $D_2O$ with a base concentration of 2 M KOH. The delay between the solution preparation and the NMR measurements is noted for each spectrum. The lactic acid (LA), acetic acid (AA), and formic acid (FA) chemical shifts are noted for reference. The NMR spectra for chemical shifts larger than 6 ppm has been multiplied by 50× to increase the visibility of the small features near the FA shift. The LA, AA, and FA peaks in the MGO, GALD, and DHA spectra are not visible in $^1H$ spectra measured in neutral $D_2O$ (FIG. 14).
Figure 14:
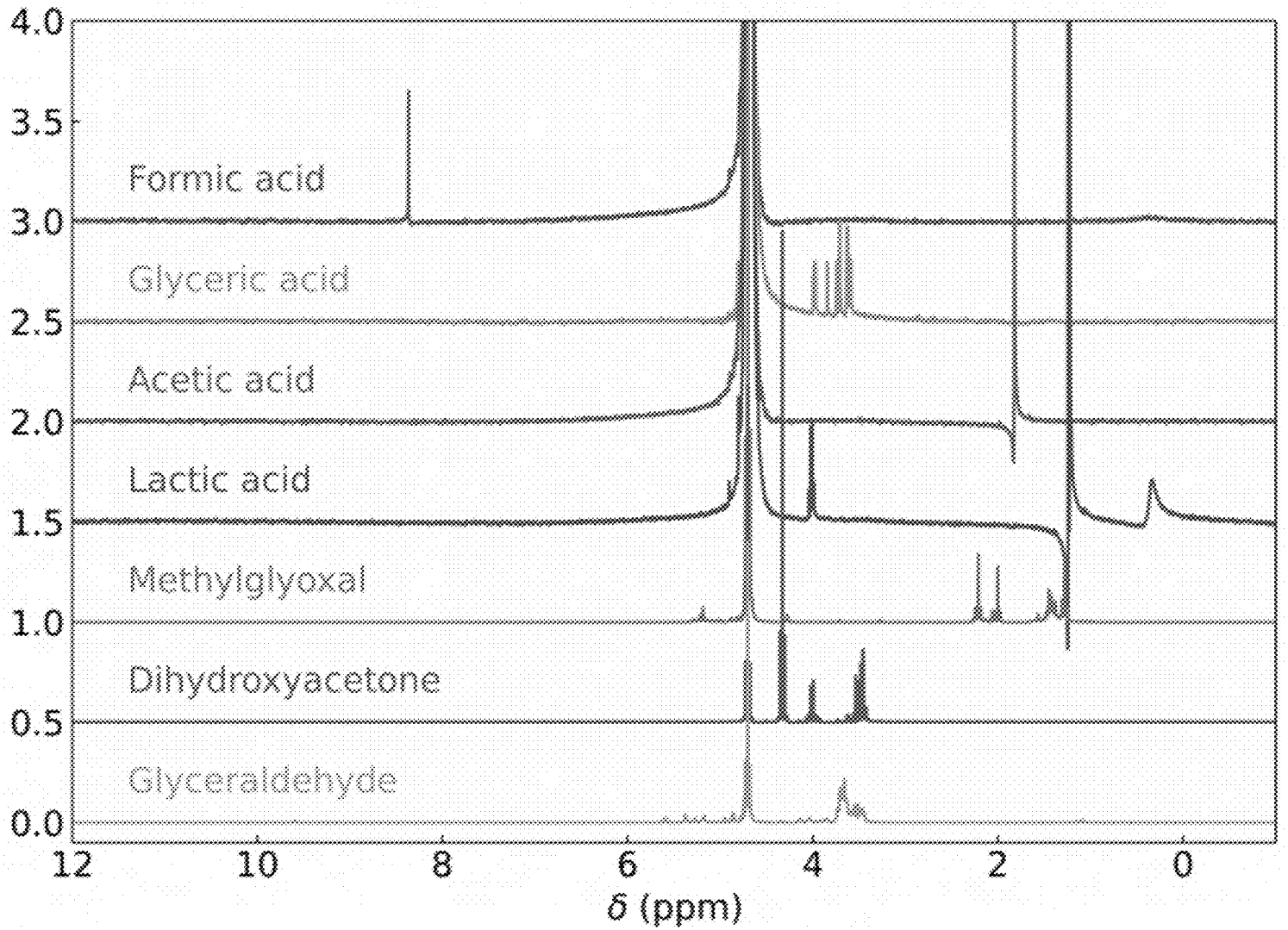
FIG. 14 shows $^1$H NMR spectra for standards of compounds relevant to NMR studies in the main text (formic acid, glyceric acid, acetic acid, lactic acid, methylglyoxal, dihydroxyacetone, and glyceraldehyde). These standards are measured in $D_2O$ with no added KOH to show the chemical shifts distinct to the electrolyte in alkaline (FIG. 9) and neutral conditions. Each solution has 100 mM of the standard compound. The methylglyoxal, dihydroxyacetone, and glyceraldehyde spectra were scaled by a factor of 0.1 compared to the other compounds for easier comparison.

We used $^1$H NMR spectroscopy to characterize the composition of the spontaneous, non-faradaic products formed in alkaline solutions from GALD, DHA, and MGO. This can help to differentiate the direct electrooxidation products from compounds formed spontaneously in solution. Panel (a) of FIG. 9 shows standard $^1$H NMR spectra as reference for glycerol, formic acid, glyceric acid, acetic acid, and lactic acid in 2 M KOH in $D_2O$. The glycerol solution was 2 M, while the other compounds were prepared at 100 mM. $^1$H NMR spectra of solutions (100 mM and 2 M KOH in $D_2O$) of GALD, DHA, and MGO are shown in panel (b) of FIG. 9. The solutions were measured within 30 min of being prepared unless noted. For comparison, we measured otherwise identical solutions without added KOH (FIG. 14). Lactate and acetate peaks are visible in NMR spectra of MGO in alkaline solutions, though not in the spectrum for the neutral solution. Smaller quantities of lactate and no significant amount of acetate are visible in the GALD and DHA spectra. A small amount of formate is visible in the spectra as well and in higher quantities for GALD and DHA than for MGO, though the formate peak overlaps with other NMR peaks related to the GALD and DHA in solution. Glycerate has been previously reported as a glycerol electrooxidation product on PtBi electrodes and may be present in the spontaneous products of GALD or DHA. However, the peaks are coincident with the intense NMR peaks for GALD and DHA and was therefore obscured if glycerate was present in the samples.

Figure 10:
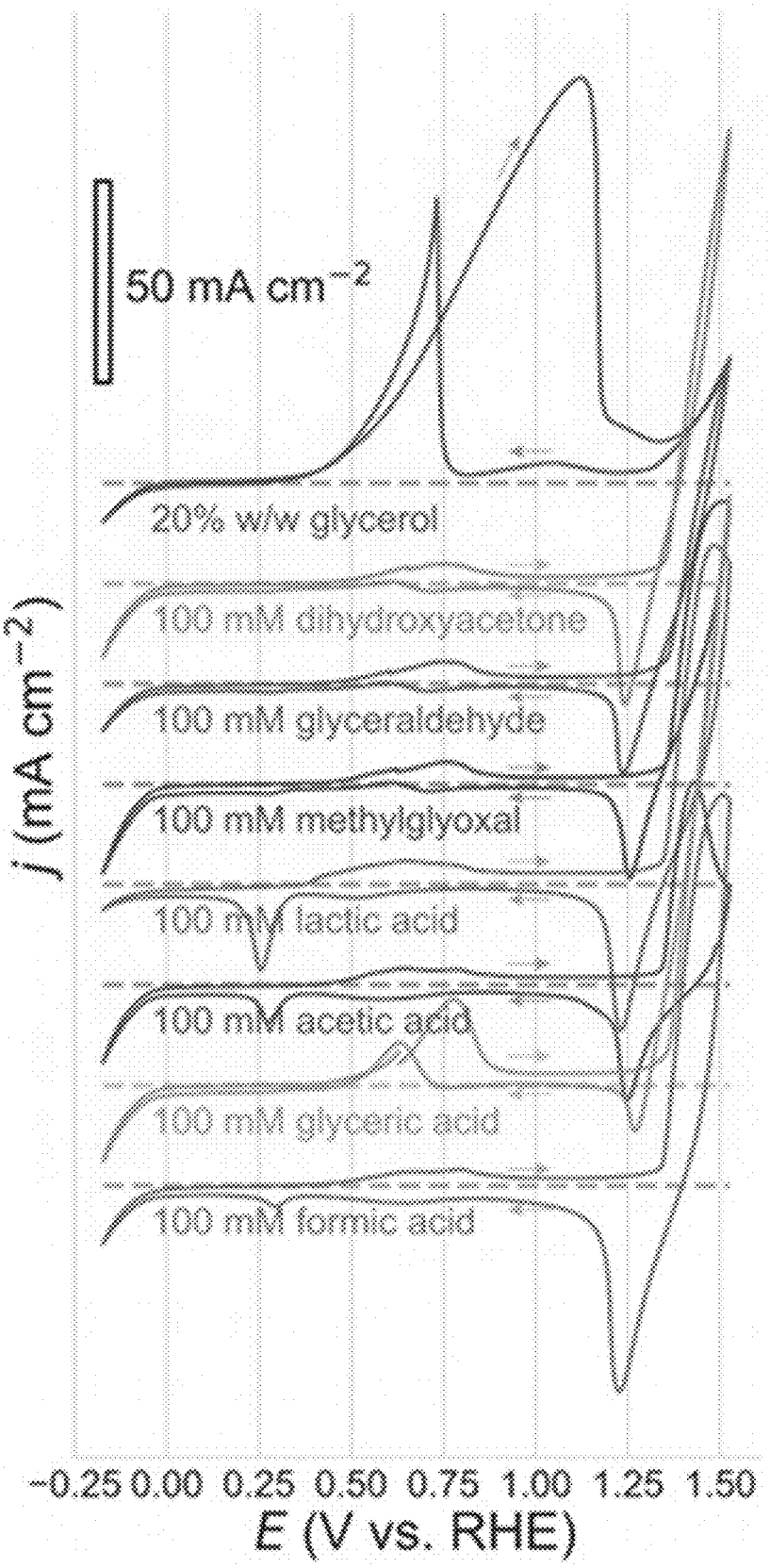
FIG. 10 shows cyclic voltammetry on AuPtBi—Ni foam electrodes (scan rate=50 mV $s^{-1}$, arrows indicate the scan direction) of glycerol electrooxidation, two electron products of glycerol electrooxidation (dihydroxyacetone, glyceraldehyde), and related compounds found in the alkaline solutions described in FIGS. 6 and 8. All solutions were prepared at the noted concentration in an aqueous solution with 2 M KOH. The x-axis (j=0 mA $cm^{-2}$) for each scan is noted by a dashed line. While glycerol oxidation commences at roughly 0.3 V vs. RHE, very little activity is observed for other compounds until significantly more positive potentials (E>1.25 V vs. RHE).

It is therefore important to identify which of the glycerol electrooxidation products will, in turn, also be electrooxidized on the AuPtBi electrocatalyst. Hydrogen evolution constrains the absolute potential of the cathode to values more negative of HER. The absolute potential of the anode is therefore limited by the amount of photovoltage generated by the power generating element (PV or PEC) of the circuit. This places a practical limit on the absolute anode potential of 0.4-0.5 V vs. RHE for a Si-driven device or 0.8-0.9 V vs. RHE for a GaAs-driven device. It is therefore important to consider which of the compounds in the analyte can be oxidized at those limiting potentials. We used cyclic voltammetry to measure the j-E response to glycerol and subsequent oxidation products in aqueous 2 M KOH on a Ni-foam based AuPtBi anode (FIG. 10). Glycerol (2 M) was the only substrate that generated anodic current at potentials below 0.5 V vs RHE (turn-on potential=0.3 V vs. RHE). The anodic current shown in FIG. 10 for glycerol oxidation on the AuPtBi—Ni foam is different than FIG. 4 due to the increased ratio of active-to-geometric area of the foam electrode. The concentration (100 mM) was chosen to be in reasonable excess of each compound that could be generated via electrocatalysis or non-faradaic conversions near the electrode surface. The onset potential for glyceric acid (100 mM) was roughly 0.5 V vs. RHE. For all other tested compounds, electrooxidation was only observed at potentials greater than 1.3 V vs. RHE, outside of the practical window for generating anodic current with either of the tested PV devices. Oxidation (forward scan) and reduction waves (return scan) waves were observed in the CVs for each of these compounds near 0.75 V vs. RHE. This potential corresponds to the Pt oxidation/reduction potential, which is consistent with the observed increase in anodic current in glycerol on the reverse scan of the CV, which indicates the return of glycerol electrooxidation activity after the surface Pt has reduced.

Based on the results of electrochemical experiments, whichever of the two electron products are formed at the electrode surface (DHA or GALD) are not electrooxidized further at the practical potential limits of either PV tested here. The NMR results shown in FIG. 9 suggest that the fate of the electrooxidation products may be to form base-catalyzed decomposition products, such as the observed lactate and formate. Further electrooxidation, to carbonate for example, requires the identification of electrocatalysts capable of oxidizing these products at the limited positive potentials consistent with the targeted operating point for glycerol electrooxidation. Otherwise, capturing desirable products from the electrolysis process is a problem of chemical separation, which has been addressed in previous work that aimed to distinguish the electrolysis- and solution-catalyzed products.

Figure 11:
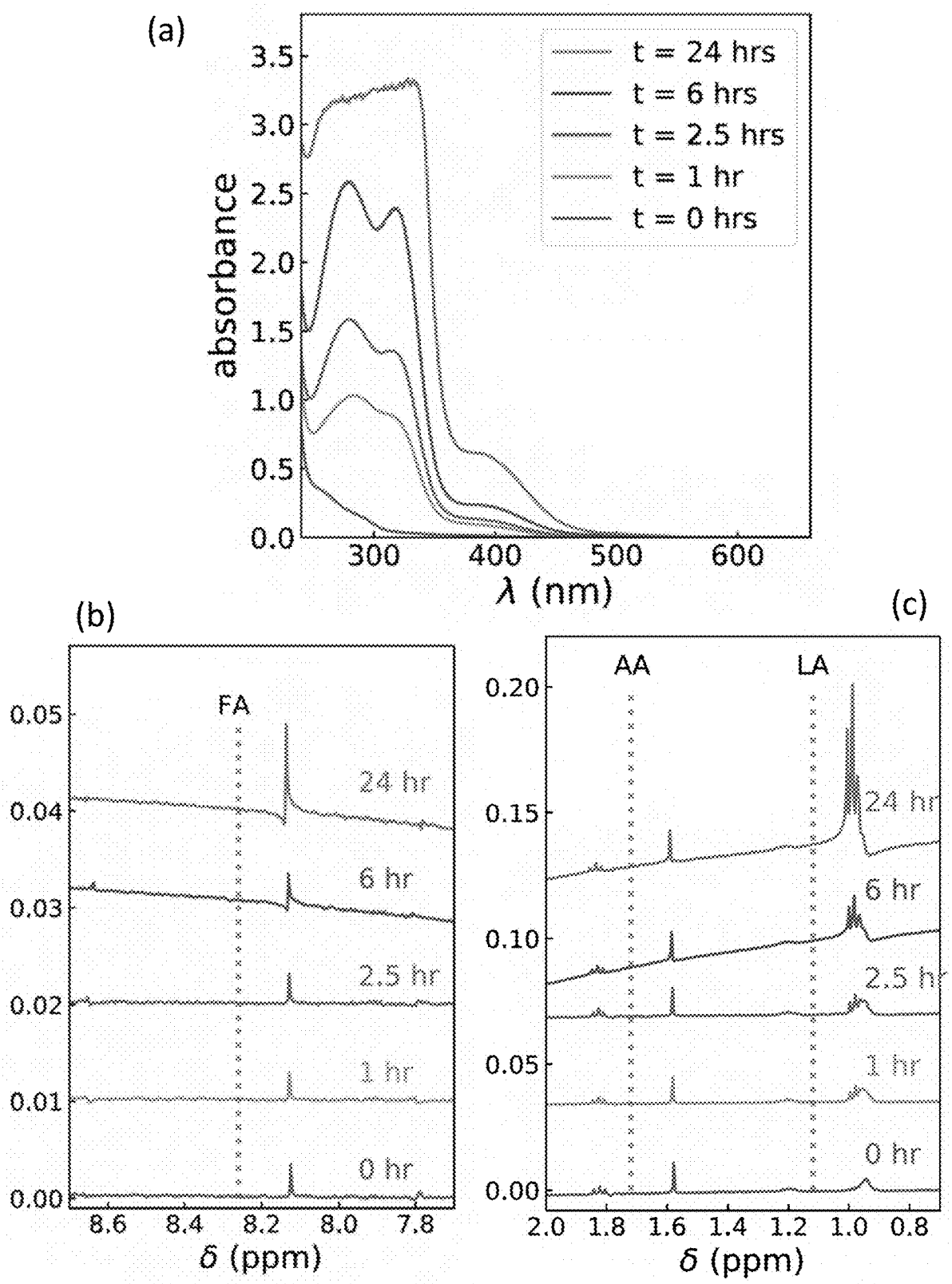
FIG. 11 shows various characterizations of an electrochemical device according to embodiments of the invention. Panel (a): UV-vis spectroscopy of the analyte for an extended galvanostatic (5 mA $cm^{-2}$) electrooxidation on a AuPtBi—Ni foam ($A_{geo}$=1 $cm^2$) electrode in 2.0 M glycerol in a 2.0 M KOH solution in $D_2O$. Panels (b)-(c): $^1H$ NMR spectra of the electrooxidation analyte in the regions corresponding to the formic acid (FA) chemical shift (panel (b)) and lactic acid (LA)/acetic acid (AA) chemical shifts (panel (c)). Chronoamperometry data (FIG. 15) and full-field NMR spectra for each sampled time (FIG. 16).
Figure 15:
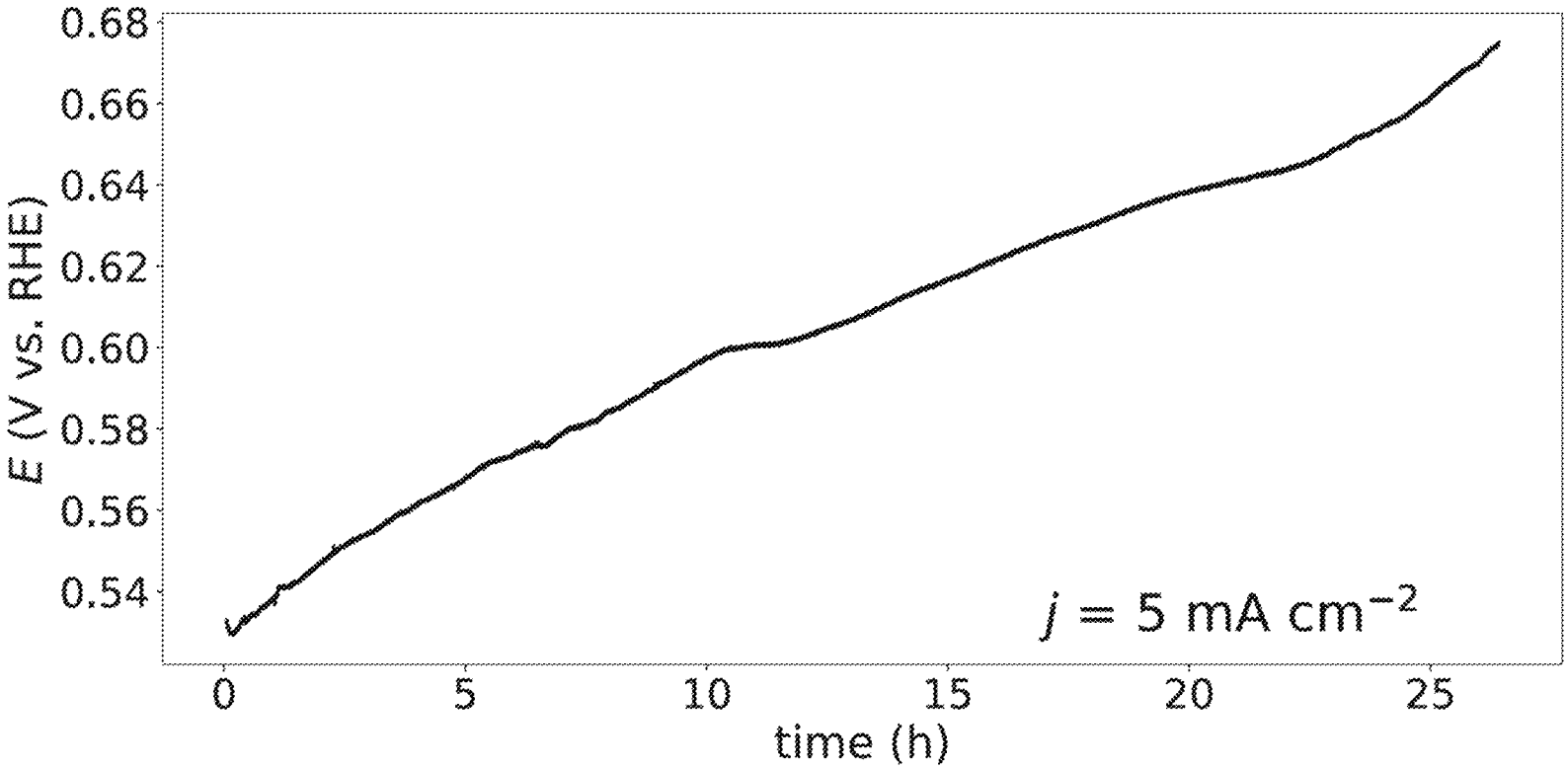
FIG. 15 shows chronopotentiometry for the AuPtBi—Ni anode run ($A_{geo}$=1 cm$^{-2}$, mesh electrode) for >24 hrs in model crude glycerol solution (20% (w/w) glycerol in 2 M KOH, FIG. 11). The electrolyte was prepared with $D_2O$ rather than water to facilitate the NMR analysis shown in panels (b)-(c) of FIG. 11, and FIG. 14.
Figure 16:
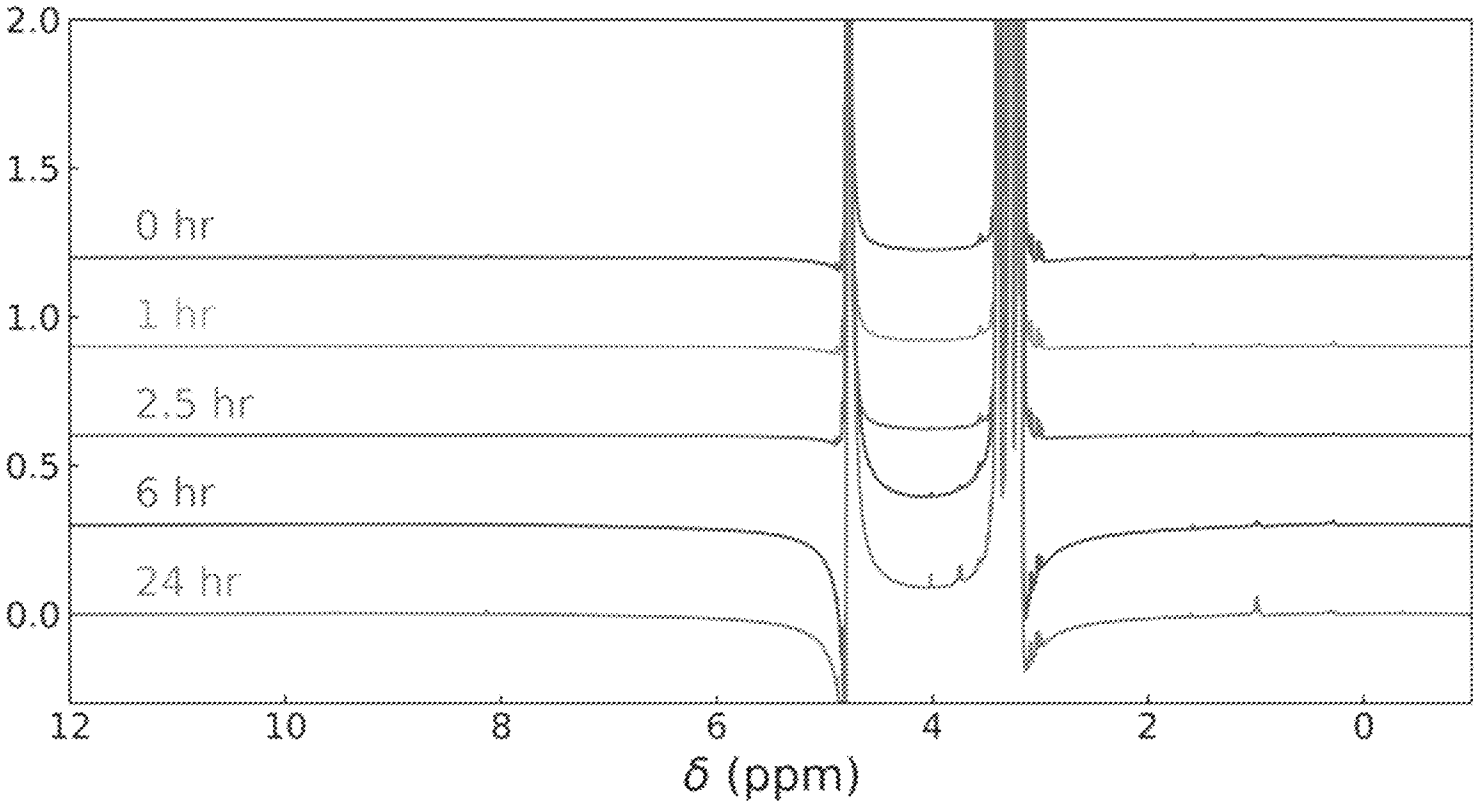
FIG. 16 shows full-field $^1$H NMR spectra for the time series of glycerol electrooxidation experiments shown in panels (b)-(c) of FIG. 11.

We performed galvanostatic (5 mA $cm^{-2}$) glycerol electrooxidation in 2 M KOH in $D_2O$ for $^1$H-NMR analysis of the glycerol reaction products over a period of 24 hr. The chronopotentiometry data for this experiment is shown in FIG. 15. Over the course of the experiment, we observed a similar color change in the analyte to the one observed when adding DHA, GALD, or MGO to the 2 M KOH solution, as shown in FIG. 8. A time series of UV-Vis experiments on the analyte (panel (a) of FIG. 11) showed the steady generation of absorption features at roughly 275 nm, 320 nm, and 400 nm that are consistent with the features observed in the spectrochemical characterization of DHA and GALD solutions, as shown in panels (a)-(b) of FIG. 8. No color change was observed in the catholyte, which was separated from the analyte by a Zirfon membrane. The corresponding time series of $^1$H NMR spectra for the analyte show the production of both formate and lactate over any background features in the initial spectra. We attribute the upfield shift in the positions of these features to be related to differences in the solvent compared to the reference spectra in FIG. 9. In the experiments shown in FIG. 11, glycerol (20% w/w) contributed as a significant portion of the solvent as well as reactant in the electrolysis. We also observed a significant shift in the baseline likely due to the steady increase of water (or HDO) formation via the electrochemical dehydrogenation of glycerol.

Given the electrochemical and analytical results outlined above, there is a practical limit to the current density that can be sustained through the AuPtBi—Ni anode. PV-driven electrolysis can scale the electrocatalytic current densities to >1 A $cm^{-2}$ due to the stability of the electrocatalytic interface for water oxidation. Cyclic voltammetry showed that increasing the true current density beyond 40 mA $cm^{-2}$ (at 1 V vs. RHE, from panel (c) of FIG. 4) resulted in the oxidation of Pt on the surface. Consequently, the layer was no longer capable of catalyzing glycerol electrolysis at low applied potentials. This ceiling on current density is still compatible with the practical targets for PEC-based STH systems, where practical targets for current densities are in the range of 10-25 mA $cm^{-2}$ under standard insolation conditions.

The search for new uses for glycerol is motivated by its prevalence as a biproduct of biodiesel synthesis. Solar energy can be used in a variety of ways, such as water splitting, electricity generation, or solar thermochemical processes. The solar power conversion efficiency metric ($\eta_{STH}$) is a method to compare the solar energy utilization across technologies. It is therefore important to consider $\eta_{STH}$ for the sacrificial oxidation of crude glycerol in the generation of $H_2$ described here. The Gibbs free energy of the full conversion of glycerol to carbon dioxide and hydrogen, $$C_3H_8O_3 + 3H_2O \longrightarrow 3CO_2 + 7H_2$$

is $\Delta G^\circ = -248$ kJ $mol^{-1}$, indicating that it is a spontaneous process. The experiments described in this work indicate that the electrooxidation of glycerol stops at one of the two electron products (either GALD or DHA) at low anode potentials. Joback method estimates of the Gibbs free energies of formation for glycerol ($\Delta G_f^\circ = -438.5$ kJ $mol^{-1}$), GALD (−401.2 kJ $mol^{-1}$), and DHA (−428.2 kJ $mol^{-1}$) result in electrolytic cell potentials of $E^\circ = -0.19$ V for glycerol-to-GALD and $E^\circ = -0.05$ V for glycerol-to-DHA. The standard form of $\eta_{STH}$ uses the electrolytic cell potential to characterize the output power:

$$\eta_{STH} = \frac{|jE^0|}{P_S} \times 100\%$$

where j is the illuminated area-normalized current density through the device (in units of A $cm^{-2}$) and $P_s$ is the power input from insolation (0.100 W $cm^{-2}$ for AM 1.5 solar spectrum). This direct definition results in low overall STH power conversion efficiencies ($\eta_{STH}$=0.53% for glycerol-to-DHA and 1.9% for glycerol-to-GALD at j=10 mA $cm^{-2}$).

Considering only the Gibbs free energy of the oxidation reaction underestimates the practical value of the reaction. It implicitly considers the power output to be the value of the galvanic reversal of the glycerol electrolysis. Though it is clear from an energy conversion perspective that any $H_2$ produced in this reaction would be recombined with atmospheric 02 rather than GALD or DHA, yielding 1.23 V of galvanic cell potential and much higher power density output. Additionally, STH efficiency metrics only account for the energy input after the system is built, avoiding the details of the energy payback time associated with the fabrication of complex integrated systems. Substituting glycerol oxidation for water oxidation in the goal of STH production can result in simpler integrated systems with lower fixed fabrication and energy costs. Additionally, it ignores the chemical and economic value of the products of glyceraldehyde oxidation described here. Given these considerations, the opportunity for glycerol electrooxidation is poorly represented by a simple, technology agnostic $\eta_{STH}$ metric.

Conclusions

STH generation can be an important valorization strategy for crude glycerol and increase the technological practicality of solar fuels systems. In general, glycerol electrooxidation provides a strategy for reducing the cell potential required to convert solar energy into hydrogen. It replaces the difficult water oxidation reaction the AuPtBi—Ni electrocatalyst described here specifically facilitates hydrogen evolution from the electrooxidation of crude glycerol at sufficiently low cell potentials to be driven by even a single Si PN junction. The measured geometric current density of the unoptimized AuPtBi—Ni crude glycerol-to-hydrogen electrolysis cell generated more than twice the theoretical maximum for hydrogen evolution for an optimal two-junction tandem water splitting cell at the same cell potential, as shown in panel (d) of FIG. 4. The prolonged operation of light-driven electrolysis under quiescent solution conditions suggests that the anode-cathode pair can serve as the basis for a large-scale, passive, and simple PV- or PEC-based glycerol-to-hydrogen integrated system. The simple synthesis also lends itself to in operando electrode restoration, either by reductive cycling (as demonstrated here) or by periodic application of the GR or electrodeposition process.

More generally, this work demonstrates that STH that can be realized on much simpler integrated system designs and higher $H_2$ production than required for an unassisted solar water splitting system. Based on the j-$E_{cell}$ performance of the electrocatalyst described here, the achievable current densities for $H_2$ evolution, and the potential energy payback time savings for simplified system designs should offset the difficulties associated with the operational requirement of an additional fuel. Further, the analytical results described here should motivate the development of methods to separate the anodic products to produce economically desirable compounds from glycerol. A STH integrated system based on glycerol oxidation is therefore an important one for advancing PV and PEC technologies for STH electrochemical storage.

Example 2

Copper Bismuth Oxide ($CuBi_2O_4$) Photocathode for Photoelectrochemical Device

In this exemplary example, we disclose a photoelectrochemical device including a photocathode with a large photovoltage for achieving solar driven glycerol oxidation.

Figure 17:
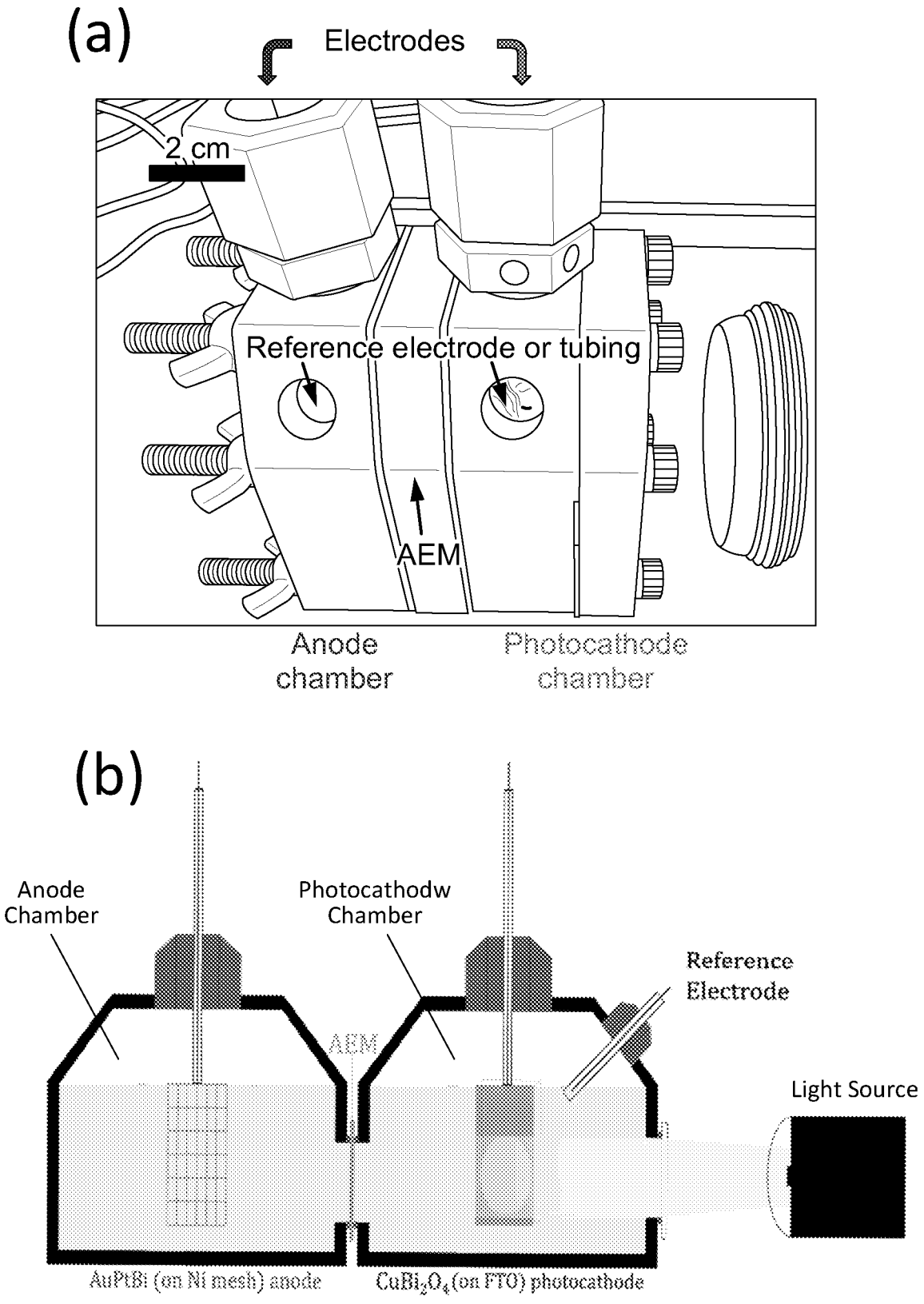
FIG. 17 shows an electrochemical device according to embodiments of the invention. Panel (a): An exemplary experiment setup, Panel (b): A schematic diagram.

Referring to FIG. 17, the photoelectrochemical device includes an anode chamber/compartment, a cathode chamber/compartment, an anion exchange membrane (AEM) separating the anode chamber and the cathode chamber, an anode electrode placed in the anode chamber and a cathode electrode placed in the cathode chamber. In this exemplary embodiment, the anode electrode is Ni based AuPtBi anode and the cathode electrode is an FTO based $CuBi_2O_4$ photocathode that is configured, when illuminated with light from a light source, to initiate photoelectrochemical oxidation/reduction reactions in the electrochemical cell.

Figure 18:
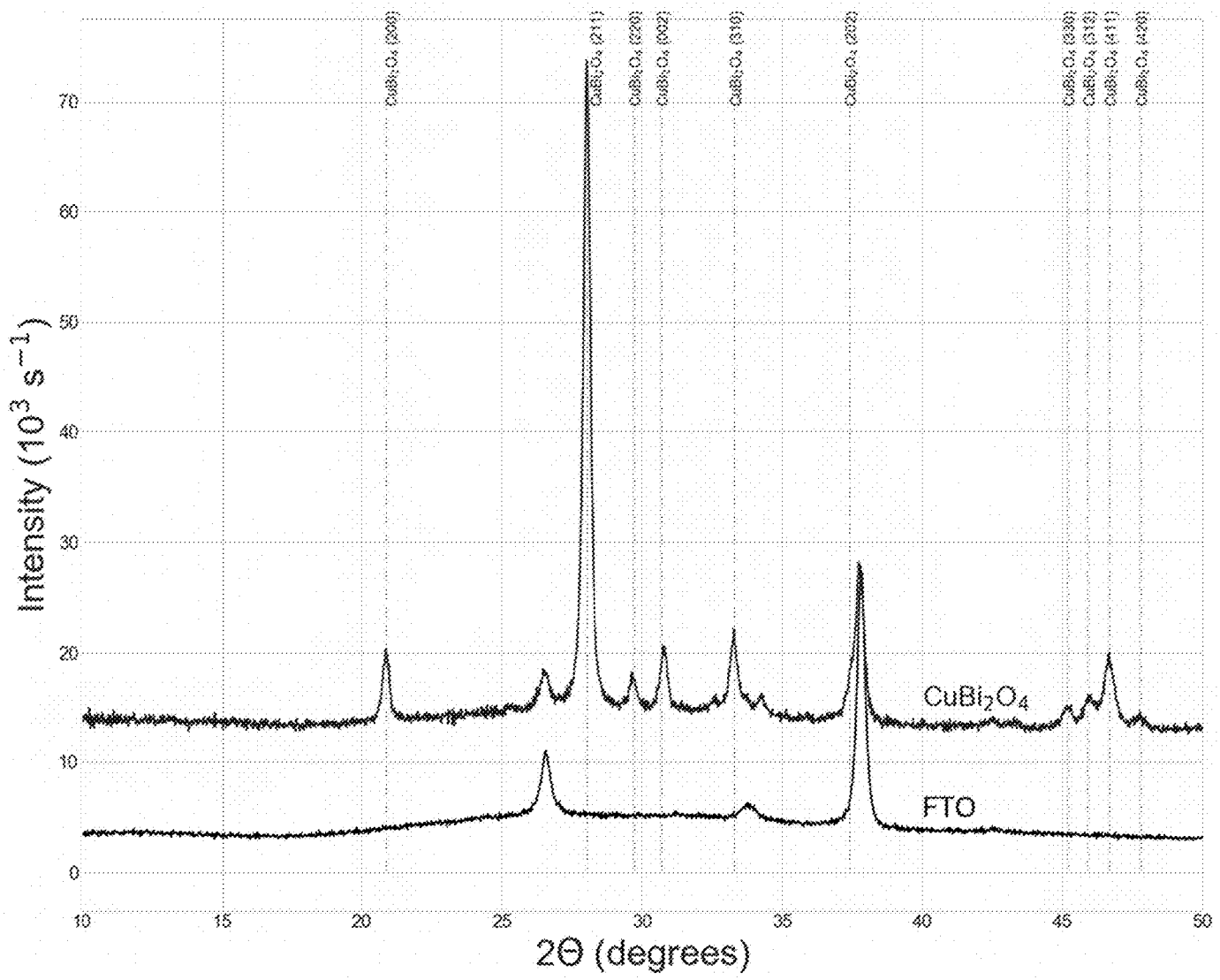
FIG. 18 shows crystallographic structures of copper bismuth oxide ($CuBi_2O_4$) and fluorine-doped tin oxide (FTO) determined with X-ray diffraction analysis (XRD).

FIG. 18 shows crystallographic structures of $CuBi_2O_4$ and FTO determined with X-ray diffraction analysis (XRD). In one embodiment, the photocathode is made with spray pyrolysis from a solution of copper (ii) nitrate and bismuth (iii) nitrate in ethylene glycol/water solution. The XRD analysis shows peaks only indicating the FTO substrate and $CuBi_2O_4$.

Figure 19:
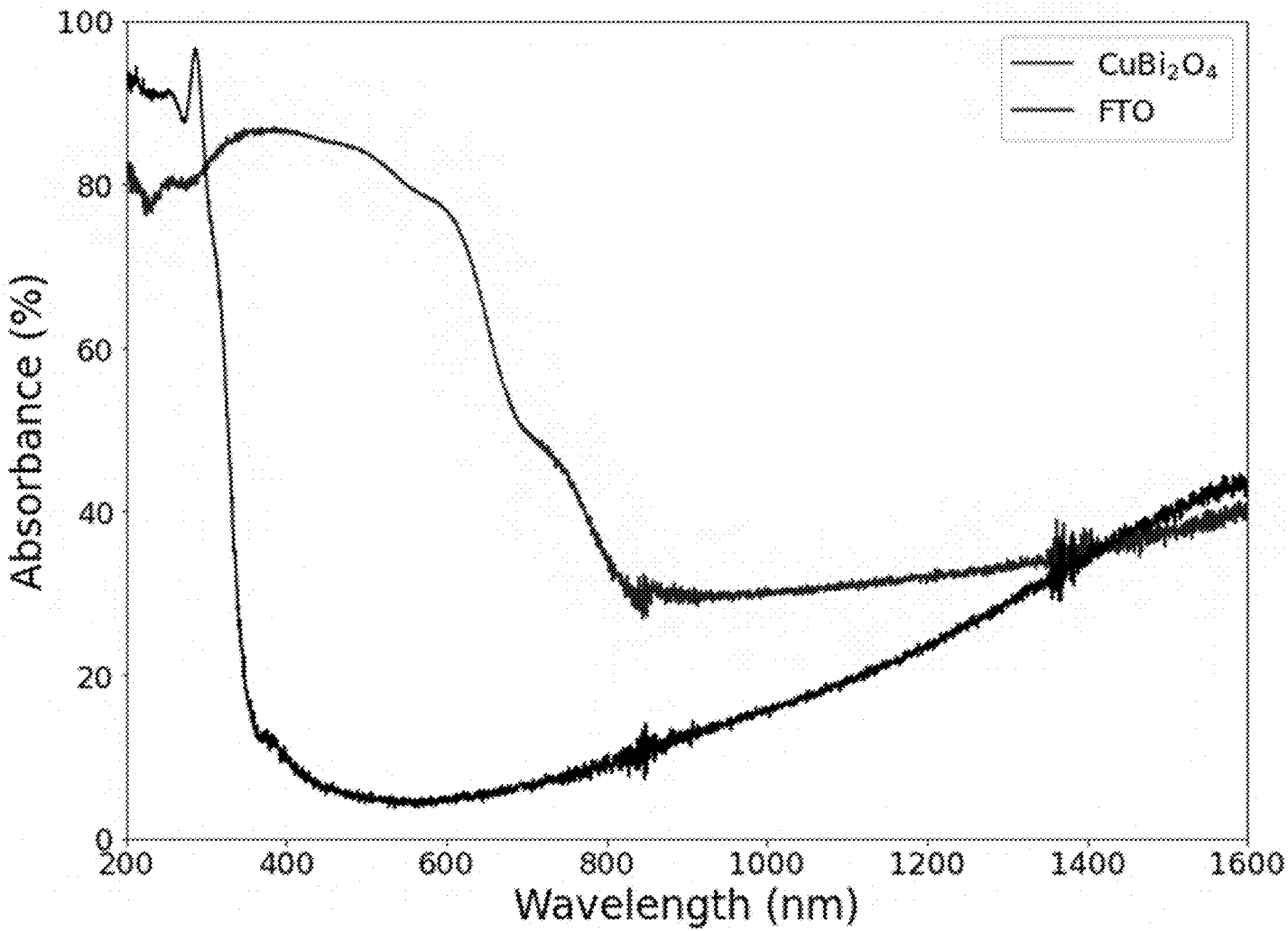
FIG. 19 shows absorption spectra of $CuBi_2O_4$ and FTO.

FIG. 19 shows absorption spectra of $CuBi_2O_4$ and FTO. In one embodiment, the $CuBi_2O_4$ is a semitransparent yellow-orange film. The absorbance is calculated from the measurements of reflectance and transmission in the UV-Vis. The absorption of $CuBi_2O_4$ stops around 850 nm, corresponding to a band gap of roughly 1.5 eV.

Figure 20:
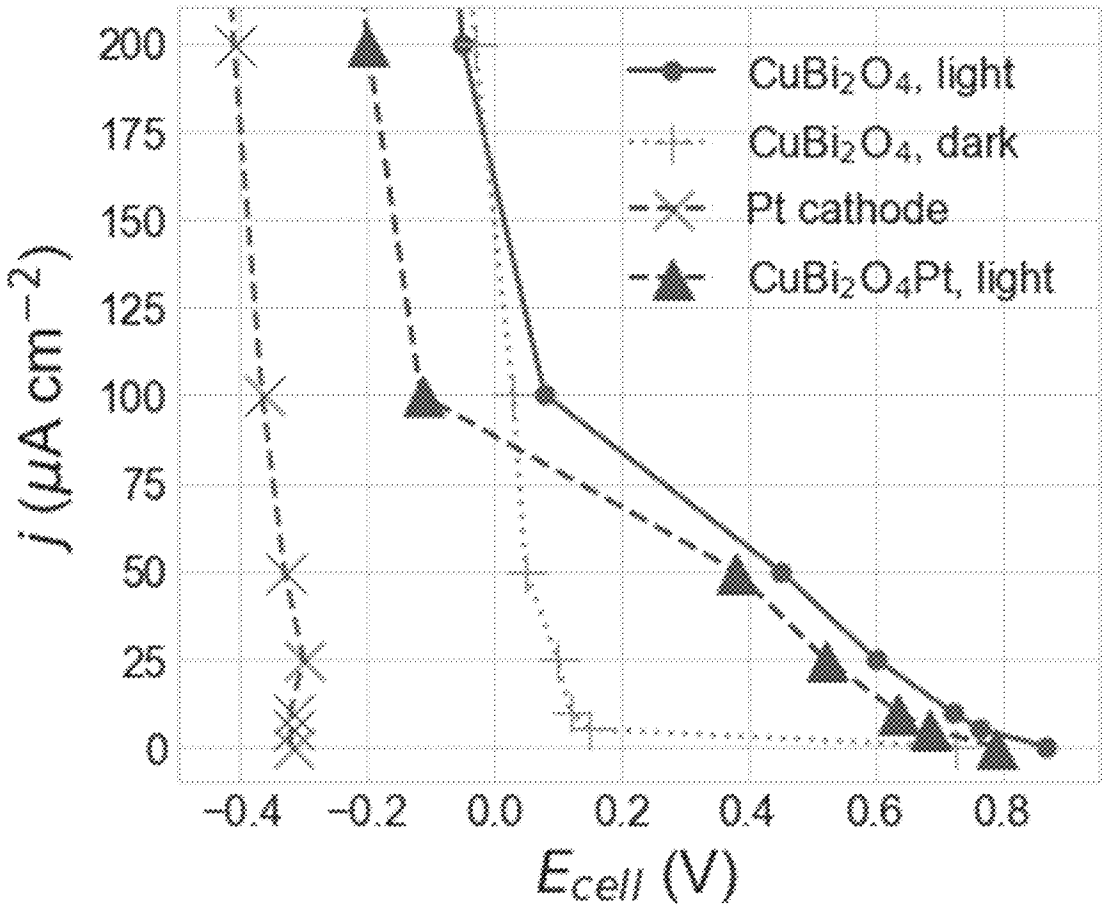
FIG. 20 shows I-V characteristic curves of $CuBi_2O_4$-driven PEC glycerol-to-$H_2$ according to embodiments of the invention. Photocathode: $CuBi_2O_4$ in 2 M NaOH. Added Pt with sputterer coater. Anode: AuPtBi in model crude glycerol. Pt dark shows $E_{cell}$ required for HER. $CuBi_2O_4$ dark shows surface reduction and photocorrosion.

FIG. 20 shows I-V characteristic curves of $CuBi_2O_4$-driven PEC glycerol-to-$H_2$ according to embodiments of the invention. Photocathode: $CuBi_2O_4$ in 2 M NaOH. Added Pt with sputterer coater. Anode: AuPtBi in model crude glycerol. Pt dark shows $E_{cell}$ required for HER. $CuBi_2O_4$ dark shows surface reduction and photocorrosion.

Figure 21:
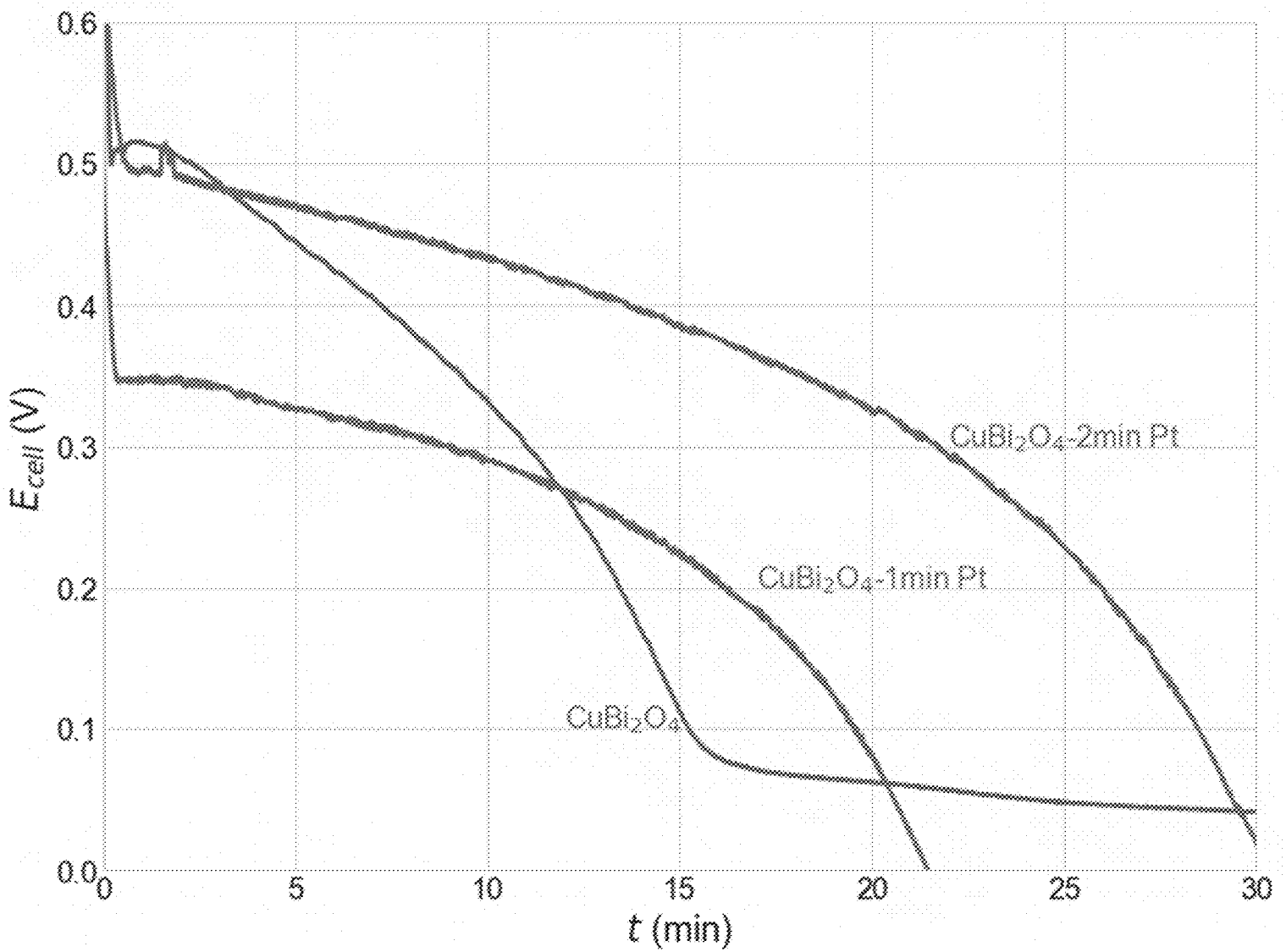
FIG. 21 shows the cell potential, $E_{cell}$, from chronopotentiometry measurements of glycerol oxidation and hydrogen evolution on a Ni based AuPtBi anode and an FTO based $CuBi_2O_4$ photocathode. Device stability of Pt sputtered onto $CuBi_2O_4$ and glycerol oxidation AuPtBi catalyst. −50 μA cm$^{-2}$ stability under illumination.

FIG. 21 shows the cell potential, $E_{cell}$, from chronopotentiometry measurements of glycerol oxidation and hydrogen evolution on a Ni based AuPtBi anode and an FTO based $CuBi_2O_4$ photocathode. Device stability of 1 min and 2 min Pt sputtered onto $CuBi_2O_4$ and glycerol oxidation AuPtBi catalyst. Stability measurement is performed at a current density of $-50\ \mu A\ cm^{-2}$ under illumination.

In sum, the invention discloses, among other things, an electrocatalyst system that reduces the amount of energy required to generate hydrogen from solar energy when using glycerol as a fuel. It is shown that a single Si solar cell can provide enough voltage to generate $H_2$ from glycerol for days, where at least 1.8 V is required for the direct splitting of water. More importantly, this catalyst can reduce the system costs and complexity required to construct an "artificial leaf", as it reduces the number of semiconductor junctions required to generate the lower voltage for solar-to-hydrogen energy conversion using glycerol. It may also avoid the need for a membrane, as glycerol oxidation product crossover may be inert to reduction on the cathode. Glycerol is a waste product of the biodiesel industry, so this invention contributes to the economics of biodiesel formation as well.

The foregoing description of the exemplary embodiments of the invention has been presented only for the purposes of illustration and description and is not intended to be exhaustive or to limit the invention to the precise forms disclosed. Many modifications and variations are possible considering the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

REFERENCE LIST

[1] Walter, M. G.; Warren, E. L.; McKone, J. R.; Boettcher, S. W.; Mi, Q.; Santori, E. A.; Lewis, N. S. Solar Water Splitting Cells. *Chem. Rev.* 2010, 110 (11), 6446-6473. https://doi.org/10.1021/cr1002326.

[2] Haussener, S.; Xiang, C.; Spurgeon, J. M.; Ardo, S.; Lewis, N. S.; Weber, A. Z. Modeling, Simulation, and Design Criteria for Photoelectrochemical Water-Splitting Systems. *Energy Environ. Sci.* 2012, 5 (12), 9922-9935. https://doi.org/10.1039/C2EE23187E.

[3] Jiang, C.; Moniz, S. J. A.; Wang, A.; Zhang, T.; Tang, J. Photoelectrochemical Devices for Solar Water Splitting—Materials and Challenges. *Chem. Soc. Rev.* 2017, 46 (15), 4645-4660. https://doi.org/10.1039/C6CS00306K.

[4] Bolton, J. R.; Strickler, S. J.; Connolly, J. S. Limiting and Realizable Efficiencies of Solar Photolysis of Water. *Nature* 1985, 316 (6028), 495-500. https://doi.org/10.1038/316495a0.

[5] Brillet, J.; Yum, J.-H.; Cornuz, M.; Hisatomi, T.; Solarska, R.; Augustynski, J.; Graetzel, M.; Sivula, K. Highly Efficient Water Splitting by a Dual-Absorber Tandem Cell. *Nat. Photonics* 2012, 6 (12), 824-828. https://doi.org/10.1038/nphoton.2012.265.

[6] Chen, Y.; Sun, K.; Audesirk, H.; Xiang, C.; Lewis, N. S. A Quantitative Analysis of the Efficiency of Solar-Driven Water-Splitting Device Designs Based on Tandem Photoabsorbers Patterned with Islands of Metallic Electrocatalysts. *Energy Environ. Sci.* 2015, 8 (6), 1736-1747. https://doi.org/10.1039/C5EE00311C.

[7] Xiang, C.; Weber, A. Z.; Ardo, S.; Berger, A.; Chen, Y.; Coridan, R.; Fountaine, K. T.; Haussener, S.; Hu, S.; Liu, R.; Lewis, N. S.; Modestino, M. A.; Shaner, M. M.; Singh, M. R.; Stevens, J. C.; Sun, K.; Walczak, K. Modeling, Simulation, and Implementation of Solar-Driven Water-Splitting Devices. *Angew. Chem. Int. Ed.* 2016, 55 (42), 12974-12988. https://doi.org/10.1002/anie.201510463.

[8] Hu, S.; Xiang, C.; Haussener, S.; Berger, A. D.; Lewis, N. S. An Analysis of the Optimal Band Gaps of Light Absorbers in Integrated Tandem Photoelectrochemical Water-Splitting Systems. *Energy Environ. Sci.* 2013, 6 (10), 2984-2993. https://doi.org/10.1039/C3EE40453F.

[9] Verlage, E.; Hu, S.; Liu, R.; Jones, R. J. R.; Sun, K.; Xiang, C.; Lewis, N. S.; Atwater, H. A. A Monolithically Integrated, Intrinsically Safe, 10% Efficient, Solar-Driven Water-Splitting System Based on Active, Stable Earth-Abundant Electrocatalysts in Conjunction with Tandem III-V Light Absorbers Protected by Amorphous TiO2 Films. *Energy Environ. Sci.* 2015, 8 (11), 3166-3172. https://doi.org/10.1039/C5EE01786F.

[10] Cheng, W.-H.; Richter, M. H.; May, M. M.; Ohlmann, J.; Lackner, D.; Dimroth, F.; Hannappel, T.; Atwater, H. A.; Lewerenz, H.-J. Monolithic Photoelectrochemical Device for Direct Water Splitting with 19% Efficiency. *ACS Energy Lett.* 2018, 3 (8), 1795-1800. https://doi.org/10.1021/acsenergylett.8b00920.

[11] Horowitz, K. A.; Remo, T. W.; Smith, B.; Ptak, A. J. *A Techno-Economic Analysis and Cost Reduction Roadmap for III-V Solar Cells*; NREL/TP—6A20-72103, 1484349; 2018; p NREL/TP—6A20-72103, 1484349. https://doi.org/10.2172/1484349.

[12] Bornoz, P.; Abdi, F. F.; Tilley, S. D.; Dam, B.; van de Krol, R.; Graetzel, M.; Sivula, K. A Bismuth Vanadate—Cuprous Oxide Tandem Cell for Overall Solar Water Splitting. *J. Phys. Chem. C* 2014, 118 (30), 16959-16966. https://doi.org/10.1021/jp500441h.

[13] Ahmet, I. Y.; Berglund, S.; Chemseddine, A.; Bogdanoff, P.; Prag, R. F.; Abdi, F. F.; Krol, R. van de. Planar and Nanostructured N—Si/Metal-Oxide/WO3/BiVO4 Monolithic Tandem Devices for Unassisted Solar Water Splitting. *Adv. Energy Sustain. Res.* 2020, (2), 2000037. https://doi.org/10.1002/aesr.202000037.

[14] Chen, Y.; Feng, X.; Liu, Y.; Guan, X.; Burda, C.; Guo, L. Metal Oxide-Based Tandem Cells for Self-Biased Photoelectrochemical Water Splitting. *ACS Energy Lett.* 2020, 5 (3), 844-866. https://doi.org/10.1021/acsenergylett.9b02620.

[15] Verma, S.; Lu, S.; Kenis, P. J. A. Co-Electrolysis of $CO_2$ and Glycerol as a Pathway to Carbon Chemicals with Improved Technoeconomics Due to Low Electricity Consumption. *Nat. Energy* 2019, 4 (6), 466-474. https://doi.org/10.1038/s41560-019-0374-6.

[16] Marshall, A. T.; Haverkamp, R. G. Production of Hydrogen by the Electrochemical Reforming of Glycerol—Water Solutions in a PEM Electrolysis Cell. *Int. J. Hydrog. Energy* 2008, 33 (17), 4649-4654. https://doi.org/10.1016/j.ijhydene.2008.05.029.

[17] Chen, Y. X.; Lavacchi, A.; Miller, H. A.; Bevilacqua, M.; Filippi, J.; Innocenti, M.; Marchionni, A.; Oberhauser, W.; Wang, L.; Vizza, F. Nanotechnology Makes Biomass Electrolysis More Energy Efficient than Water Electrolysis. *Nat. Commun.* 2014, 5, 4036. https://doi.org/10.1038/ncomms5036.

[18] Gomes, J. F.; Tremiliosi-Filho, G. Spectroscopic Studies of the Glycerol Electro-Oxidation on Polycrystalline Au and Pt Surfaces in Acidic and Alkaline Media. *Electrocatalysis* 2011, 2 (2), 96-105. https://doi.org/10.1007/s12678-011-0039-0.

[19] Simões, M.; Baranton, S.; Coutanceau, C. Enhancement of Catalytic Properties for Glycerol Electrooxidation on Pt and Pd Nanoparticles Induced by Bi Surface Modification. *Appl. Catal. B Environ.* 2011, 110, 40-49. https://doi.org/10.1016/j.apcatb.2011.08.020.

[20] Simões, M.; Baranton, S.; Coutanceau, C. Electrochemical Valorisation of Glycerol. *ChemSusChem* 2012, 5 (11), 2106-2124. https://doi.org/10.1002/cssc.201200335.

[21] Coutanceau, C.; Baranton, S.; Kouamé, R. S. B. Selective Electrooxidation of Glycerol Into Value-Added Chemicals: A Short Overview. Front. Chem. 2019, 7, 100. https://doi.org/10.3389/fchem.2019.00100.

[22] Yang, F.; Hanna, M. A.; Sun, R. Value-Added Uses for Crude Glycerol—a Byproduct of Biodiesel Production. *Biotechnol. Biofuels* 2012, 5 (1), 13. https://doi.org/10.1186/1754-6834-5-13.

[23] Da Silva, R. G.; Aquino Neto, S.; Kokoh, K. B.; De Andrade, A. R. Electroconversion of Glycerol in Alkaline Medium: From Generation of Energy to Formation of Value-Added Products. *J. Power Sources* 2017, 351, 174-182. https://doi.org/10.1016/j.jpowsour.2017.03.101.

[24] Sathre, R.; Scown, C. D.; Morrow, W. R.; Stevens, J. C.; Sharp, I. D.; Ager, J. W.; Walczak, K.; Houle, F. A.; Greenblatt, J. B. Life-Cycle Net Energy Assessment of Large-Scale Hydrogen Production via Photoelectrochemical Water Splitting. *Energy Environ. Sci.* 2014, 7 (10), 3264-3278. https://doi.org/10.1039/C4EE01019A.

[25] Dai, C.; Sun, L.; Liao, H.; Khezri, B.; Webster, R. D.; Fisher, A. C.; Xu, Z. J. Electrochemical Production of Lactic Acid from Glycerol Oxidation Catalyzed by AuPt Nanoparticles. *J. Catal.* 2017, 356, 14-21. https://doi.org/10.1016/j.jcat.2017.10.010.

[26] Schichtl, Z. G.; Mehrabi, H.; Coridan, R. H. Electrooxidation of Glycerol on Self-Organized, Mixed Au—Pt Interfaces Formed on Ni Substrates. *J. Electrochem. Soc.* 2020, 167 (5), 056502. https://doi.org/10.1149/1945-7111/ab679e.

[27] Greeley, J.; Stephens, I. E. L.; Bondarenko, A. S.; Johansson, T. P.; Hansen, H. A.; Jaramillo, T. F.; Rossmeisl, J.; Chorkendorff, I.; Nørskov, J. K. Alloys of Platinum and Early Transition Metals as Oxygen Reduction Electrocatalysts. *Nat. Chem.* 2009, 1 (7), 552-556. https://doi.org/10.1038/nchem.367.

[28] Li, M.; Duanmu, K.; Wan, C.; Cheng, T.; Zhang, L.; Dai, S.; Chen, W.; Zhao, Z.; Li, P.; Fei, H.; Zhu, Y.; Yu, R.; Luo, J.; Zang, K.; Lin, Z.; Ding, M.; Huang, J.; Sun, H.; Guo, J.; Pan, X.; Goddard, W. A.; Sautet, P.; Huang, Y.; Duan, X. Single-Atom Tailoring of Platinum Nanocatalysts for High-Performance Multifunctional Electrocatalysis. *Nat. Catal.* 2019, 2 (6), 495-503. https://doi.org/10.1038/s41929-019-0279-6.

[29] Wu, Z.-P.; Shan, S.; Zang, S.-Q.; Zhong, C.-J. Dynamic Core—Shell and Alloy Structures of Multimetallic Nanomaterials and Their Catalytic Synergies. Acc. Chem. Res. 2020, 53 (12), 2913-2924. https://doi.org/10.1021/acs.accounts.0c00564.

[30] Wu, Z.-P.; Caracciolo, D. T.; Maswadeh, Y.; Wen, J.; Kong, Z.; Shan, S.; Vargas, J. A.; Yan, S.; Hopkins, E.; Park, K.; Sharma, A.; Ren, Y.; Petkov, V.; Wang, L.; Zhong, C.-J. Alloying—Realloying Enabled High Durability for Pt—Pd-3d-Transition Metal Nanoparticle Fuel Cell Catalysts. *Nat. Commun.* 2021, 12 (1), 859. https://doi.org/10.1038/s41467-021-21017-6.

[31] Kwon, Y.; Birdja, Y.; Spanos, I.; Rodriguez, P.; Koper, M. T. M. Highly Selective Electro-Oxidation of Glycerol to Dihydroxyacetone on Platinum in the Presence of Bismuth. *ACS Catal.* 2012, 2 (5), 759-764. https://doi.org/10.1021/cs200599g.

[32] Garcia, A. C.; Birdja, Y. Y.; Tremiliosi-Filho, G.; Koper, M. T. M. Glycerol Electro-Oxidation on Bismuth-Modified Platinum Single Crystals. *J. Catal.* 2017, 346, 117-124. https://doi.org/10.1016/j.jcat.2016.12.013.

[33] de Souza, M. B. C.; Vicente, R. A.; Yukuhiro, V. Y.; V. M. T. Pires, C. T. G.; Cheuquepán, W.; Bott-Neto, J. L.; Solla-Gullón, J.; Fernandez, P. S. Bi-Modified Pt Electrodes toward Glycerol Electrooxidation in Alkaline Solution: Effects on Activity and Selectivity. *ACS Catal.* 2019, 9 (6), 5104-5110. https://doi.org/10.1021/acscatal.9b00190.

[34] Brandner, A.; Lehnert, K.; Bienholz, A.; Lucas, M.; Claus, P. Production of Biomass-Derived Chemicals and Energy: Chemocatalytic Conversions of Glycerol. *Top. Catal.* 2009, 52 (3), 278-287. https://doi.org/10.1007/s11244-008-9164-2.

[35] Villa, A.; Campisi, S.; Chan-Thaw, C. E.; Motta, D.; Wang, D.; Prati, L. Bismuth Modified Au—Pt Bimetallic Catalysts for Dihydroxyacetone Production. *Catal. Today* 2015, 249, 103-108. https://doi.org/10.1016/j.cattod.2014.12.012.

[36] Motta, D.; Trujillo, F. J. S.; Dimitratos, N.; Villa, A.; Prati, L. An Investigation on AuPt and AuPt—Bi on Granular Carbon as Catalysts for the Oxidation of Glycerol under Continuous Flow Conditions. *Catal. Today* 2018, 308, 50-57. https://doi.org/10.1016/j.cattod.2017.10.012.

[37] Velazquez-Hernandez, I.; Zamudio, E.; Rodriguez-Valadez, F. J.; Garcia-Gomez, N. A.; Alvarez-Contreras, L.; Guerra-Balcázar, M.; Arjona, N. Electrochemical Valorization of Crude Glycerol in Alkaline Medium for Energy Conversion Using Pd, Au and PdAu Nanomaterials. *Fuel* 2020, 262, 116556. https://doi.org/10.1016/j.fuel.2019.116556.

[38] Coridan, R. H.; Nielander, A. C.; Francis, S. A.; McDowell, M. T.; Dix, V.; Chatman, S. M.; Lewis, N. S. Methods for Comparing the Performance of Energy-Conversion Systems for Use in Solar Fuels and Solar Electricity Generation. *Energy Environ. Sci.* 2015, 8 (10), 2886-2901. https://doi.org/10.1039/C5EE00777A.

[39] Hu, S.; Luo, X.; Wan, C.; Li, Y. Characterization of Crude Glycerol from Biodiesel Plants. *J. Agric. Food Chem.* 2012, 60 (23), 5915-5921. https://doi.org/10.1021/jf3008629.

[40] Liu, Y.; Yu, W.; Raciti, D.; Gracias, D. H.; Wang, C. Electrocatalytic Oxidation of Glycerol on Platinum. *J. Phys. Chem. C* 2019, 123 (1), 426-432. https://doi.org/10.1021/acs.jpcc.8b08547.

[41] Pourbaix, M. Atlas of Electrochemical Equilibria in Aqueous Solution. *NACE* 1974, 307.

[42] Burke, L. D.; Nugent, P. F. The Electrochemistry of Gold: I the Redox Behaviour of the Metal in Aqueous Media. *Gold Bull.* 1997, 30 (2), 43-53. https://doi.org/10.1007/BF03214756.

[43] Burke, L. D.; Nugent, P. F. The Electrochemistry of Gold: II the Electrocatalytic Behaviour of the Metal in Aqueous Media. *Gold Bull.* 1998, 31 (2), 39-50. https://doi.org/10.1007/BF03214760.

[44] Burke, L. D.; Collins, J. A.; Horgan, M. A.; Hurley, L. M.; O'Mullane, A. P. The Importance of the Active States of Surface Atoms with Regard to the Electrocatalytic Behaviour of Metal Electrodes in Aqueous Media. *Electrochimica Acta* 2000, 45 (25), 4127-4134. https://doi.org/10.1016/S0013-4686(00)00532-6.

[45] Burke, L. D.; Moran, J. M.; Nugent, P. F. Cyclic Voltammetry Responses of Metastable Gold Electrodes in Aqueous Media. *J. Solid State Electrochem.* 2003, 7 (9), 529-538. https://doi.org/10.1007/s10008-003-0359-y.

[46] Burke, L. D. Scope for New Applications for Gold Arising from the Electrocatalytic Behaviour of Its Metastable Surface States. *Gold Bull.* 2004, 37 (1), 125-135. https://doi.org/10.1007/BF03215520.

[47] Kwon, Y.; Lai, S. C. S.; Rodriguez, P.; Koper, M. T. M. Electrocatalytic Oxidation of Alcohols on Gold in Alkaline Media: Base or Gold Catalysis? *J. Am. Chem. Soc.* 2011, 133 (18), 6914-6917. https://doi.org/10.1021/ja200976j.

[48] Oliveira, V. L.; Morais, C.; Servat, K.; Napporn, T. W.; Tremiliosi-Filho, G.; Kokoh, K. B. Glycerol Oxidation on Nickel Based Nanocatalysts in Alkaline Medium—Identification of the Reaction Products. *J. Electroanal. Chem.* 2013, 703, 56-62. https://doi.org/10.1016/j.jelechem.2013.05.021.

[49] Moulder, J. F.; Stickle, W. F.; Sobol, P. E.; Bomben, K. D. *Handbook of X Ray Photoelectron Spectroscopy: A Reference Book of Standard Spectra for Identification and Interpretation of Xps Data*; Physical Electronics: Eden Prairie, Minn., 1995.

[50] Wang, D.; Cui, X.; Xiao, Q.; Hu, Y.; Wang, Z.; Yiu, Y. M.; Sham, T. K. Electronic Behaviour of Au—Pt Alloys and the 4f Binding Energy Shift Anomaly in Au Bimetallics-X-Ray Spectroscopy Studies. *AIP Adv.* 2018, 8 (6), 065210. https://doi.org/10.1063/1.5027251.

[51] Sunpower. MAXEON™ GEN II SOLAR CELLS.

[52] Ralph, E. L.; Linder, E. B. Advanced Solar Panel Designs. In *Conference Record of the Twenty Fifth IEEE Photovoltaic Specialists Conference*—1996; IEEE: Washington, DC, USA, 1996; pp 297-300. https://doi.org/10.1109/PVSC.1996.564004.

[53] Fedoroňko, M.; Königstein, J. Kinetics of Mutual Isomerization of Trioses and Their Dehydration to Methylglyoxal. *Collect. Czechoslov. Chem. Commun.* 1969, 34 (12), 3881-3894. https://doi.org/10.1135/cccc19693881.

[54] Evans, W. L.; Cornthwaite, W. R. The Mechanism of Carbohydrate Oxidation. VII. The Action of Potassium Hydroxide on Dihydroxy Acetone. *J Am. Chem. Soc.* 1928, 50 (2), 486-492. https://doi.org/10.1021/ja01389a036.

[55] Bagheri, S.; Julkapli, N. M.; Yehye, W. A. Catalytic Conversion of Biodiesel Derived Raw Glycerol to Value Added Products. *Renew. Sustain. Energy Rev.* 2015, 41, 113-127. https://doi.org/10.1016/j.rser.2014.08.031.

[56] Kimura, H. Oxidation Assisted New Reaction of Glycerol. *Polym. Adv. Technol.* 2001, 12 (11-12), 697-710. https://doi.org/10.1002/pat.91.

[57] Carmo, M.; Fritz, D. L.; Mergel, J.; Stolten, D. A Comprehensive Review on PEM Water Electrolysis. *Int. J. Hydrog. Energy* 2013, 38 (12), 4901-4934. https://doi.org/10.1016/j.ijhydene.2013.01.151.

[58] DDB Online Property Estimation by the Joback Method http://ddbonline.ddbst.com/OnlinePropertyEstimation/OnlinePropertyEstimation.exe.

[59] A. V. Tripković, K. Dj. Popović, R. M. Stevanović, R. Socha, and A. Kowal, *Activity of a PtBi Alloy in the Electrochemical Oxidation of Formic Acid*, Electrochemistry Communications 8, 1492 (2006).

[60] P. D. Vaidya and A. E. Rodrigues, Glycerol Reforming for Hydrogen Production: A Review, *Chemical Engineering & Technology* 32, 1463 (2009).

[61] X. Lu, S. Xie, H. Yang, Y. Tong, and H. Ji, Photoelectrochemical Hydrogen Production from Biomass Derivatives and Water, *Chemical Society Reviews* 43, 7581 (2014).

[62] L.-W. Huang, T.-G. Vo, and C.-Y. Chiang, *Converting Glycerol Aqueous Solution to Hydrogen Energy and Dihydroxyacetone by the BiVO4 Photoelectrochemical Cell*, Electrochimica Acta 322, 134725 (2019).

[63] D. Liu, J.-C. Liu, W. Cai, J. Ma, H. B. Yang, H. Xiao, J. Li, Y. Xiong, Y. Huang, and B. Liu, *Selective Photoelectrochemical Oxidation of Glycerol to High Value-Added Dihydroxyacetone*, Nat Commun 10, 1 (2019).

[64] M. S. E. Houache, R. Safari, U. O. Nwabara, T. Rafaïdeen, G. A. Botton, P. J. A. Kenis,

[65] S. Baranton, C. Coutanceau, and E. A. Baranova, *Selective Electrooxidation of Glycerol to Formic Acid over Carbon Supported $Ni_{1-x}M_x$ (M=Bi, Pd and Au) Nano-Catalysts and Co-Electrolysis of CO2*, ACS Appl. Energy Mater. (2020).

[66] C. Liu, M. Hirohara, T. Maekawa, R. Chang, T. Hayashi, and C.-Y. Chiang, *Selective Electro-Oxidation of Glycerol to Dihydroxyacetone by a Non Precious Electrocatalyst—CuO*, Applied Catalysis B: Environmental 265, 118543 (2020).

[67] R. D. Cortright and J. A. Dumesic, *Low-Temperature Hydrogen Production from Oxygenated Hydrocarbons*, U.S. Pat. No. 7,618,612B2 (17 Nov. 2009).

[68] Y. Hamada, H. Ohara, M. Okuno, JP2010285320A (24 Dec. 2010).

[69] Y. Hamada, H. Ohara, M. Okuno, JP2011006298A (13 Jan. 2011).

[70] G. J. Suppes and W. R. Sutterlin, *Process for Producing a Mixture of Acetol, Propylene Glycol and Ethylene Glycol from Glycerol*, EP1948582B1 (7 Dec. 2011).

[71] G. J. Suppes, W. R. Sutterlin, and M. Dasari, *Method of Producing Lower Alcohols from Glycerol*, U.S. Pat. No. 7,943,805B2 (17 May 2011).

[72] S. Ardo, M. Shaner, R. Coridan, N. C. Strandwitz, J. R. McKone, K. Fountaine, H. A. Atwater, and N. S. Lewis, *Semiconductor Structures for Fuel Generation*, US20130269761A1 (17 Oct. 2013).

[73] P. J. A. Kenis, S. Verma, and S. Lu, *Methods for the Electroreduction of Carbon Dioxide to Value Added Chemicals*, US20190055656A1 (21 Feb. 2019).

What is claimed is:

1. A photoelectrochemical device for hydrogen generation, comprising:

at least one electrochemical cell comprising an anode compartment, a cathode compartment, an anion exchange membrane separating the anode compartment and the cathode compartment, an anode electrode placed in the anode compartment, and a cathode electrode placed in the cathode compartment, wherein the anode electrode comprises a substrate and a metal-based electrocatalyst formed on the substrate, wherein the metal-based electrocatalyst is a layered Au—Pt—Bi electrocatalyst comprising an Au—Pt base layer and a Bi layer deposited on the Au—Pt base layer, and wherein the anode compartment contains an electrolyte comprising glycerol, and a Bi-containing salt comprising $Bi(NO_3)_3$ added in the electrolyte; and a photovoltaic module integrated with the at least one electrochemical cell such that the cathode electrode of the at least one electrochemical cell is a photocathode and adapted for converting energy of photons to electrical energy for driving the at least one electrochemical cell to facilitate redox reactions therein, wherein the at least one electrochemical cell is configured to generate hydrogen from glycerol oxidation at a cell potential driven from the photovoltaic module under illumination, the cell potential being as low as 0.4 V and smaller than 1.7 V that is a minimal practical potential required for water splitting; and in-situ restore electrocatalytic activity of the anode electrode via a periodic cathodic reverse step to re-deposit Bi from the Bi-containing salt added to the electrolyte, thereby maintaining performance for an extended duration.

2. The photoelectrochemical device of claim 1, wherein the substrate comprises a current collecting electrode conformally coated with the metal-based electrocatalyst.

3. The photoelectrochemical device of claim 1, wherein the photocathode is an fluorine-doped tin oxide (FTO) based $CuBi_2O_4$ photocathode.

4. The photoelectrochemical device of claim 1, wherein the photovoltaic module comprises photon absorbers formed with single or multiple junctions.

5. The photoelectrochemical device of claim 4, wherein the photon absorbers comprise multiple layers with each formed of a different semiconductor.

6. The photoelectrochemical device of claim 5, wherein the multiple layers are stacked on the top of each other in a tandem configuration.

* * * * *